US011761716B2

(12) United States Patent
Ojanperä

(10) Patent No.: US 11,761,716 B2
(45) Date of Patent: Sep. 19, 2023

(54) HEAT EXCHANGER WITH A BOND AND A METHOD FOR MANUFACTURING THE SAME

(71) Applicant: Valmet Technologies Oy, Espoo (FI)

(72) Inventor: Juha Ojanperä, Pirkkala (FI)

(73) Assignee: VALMET TECHNOLOGIES OY, Espoo (FI)

( * ) Notice: Subject to any disclaimer, the term of this patent is extended or adjusted under 35 U.S.C. 154(b) by 377 days.

(21) Appl. No.: 17/051,645

(22) PCT Filed: May 9, 2019

(86) PCT No.: PCT/FI2019/050363

§ 371 (c)(1),
(2) Date: Oct. 29, 2020

(87) PCT Pub. No.: WO2019/224424

PCT Pub. Date: Nov. 28, 2019

(65) Prior Publication Data

US 2021/0231389 A1 Jul. 29, 2021

(30) Foreign Application Priority Data

May 21, 2018 (FI) ..... 20185466

(51) Int. Cl.
*F28F 9/013* (2006.01)
*F28D 1/047* (2006.01)
(Continued)

(52) U.S. Cl.
CPC ..... *F28F 9/0131* (2013.01); *F22B 37/205* (2013.01); *F28D 1/0475* (2013.01); *F28F 9/26* (2013.01)

(58) Field of Classification Search
CPC ..... F16L 3/22; F22B 31/0084; F22B 37/20; F22B 37/205; F28D 1/047; F28D 1/0475;
(Continued)

(56) References Cited

U.S. PATENT DOCUMENTS 2,843,363 A 7/1958 Mailander
6,019,070 A 2/2000 Duffy
(Continued)

FOREIGN PATENT DOCUMENTS

CN 101281004 A 10/2008
CN 105466253 A 4/2016
(Continued)

OTHER PUBLICATIONS

Chinese Office Action for Chinese Application No. 2019800336210, dated Jan. 21, 2022, (6 pages), China National Intellectual Property Administration, Beijing City, China.
(Continued)

*Primary Examiner* — Eric S Ruppert
*Assistant Examiner* — Hans R Weiland
(74) *Attorney, Agent, or Firm* — Alston & Bird LLP

(57) ABSTRACT

A heat exchanger having a first heat transfer tube with a first primary straight part and a first secondary straight part is provided. The heat exchanger includes a first primary bond part and a first secondary bond part. The first primary bond part is welded to the first secondary bond part to form a first primary bond that bonds the first primary straight part and the first secondary straight part of the first heat transfer tube. The first primary bond limits a first primary aperture and a first secondary aperture formed by the holes of the bond parts, wherein the straight parts of the first heat transfer tube extend through the first primary bond via the apertures.

19 Claims, 12 Drawing Sheets

(51) Int. Cl.
*F28F 9/26* (2006.01)
*F22B 37/20* (2006.01)

(58) Field of Classification Search
CPC .... F28D 7/08; F28D 7/02; F28F 9/013; F28F 9/0131; F28F 9/26
See application file for complete search history.

(56) References Cited

U.S. PATENT DOCUMENTS

| | | | | |
|---|---|---|---|---|
| 6,321,691 | B1 | 11/2001 | Harth, III | |
| 7,823,630 | B2 | 11/2010 | Itoh et al. | |
| 8,141,502 | B2 | 3/2012 | Etelhäaho et al. | |
| 8,757,248 | B2 | 6/2014 | Postma et al. | |
| 9,371,987 | B2 | 6/2016 | Petänen et al. | |
| 2008/0245513 | A1 | 10/2008 | Itoh et al. | |
| 2010/0200203 | A1 | 8/2010 | Postma et al. | |
| 2011/0146598 | A1* | 6/2011 | Conner | F22B 37/205 29/897.3 |
| 2011/0239960 | A1 | 10/2011 | Komai et al. | |
| 2011/0253341 | A1* | 10/2011 | Al-Otaibi | F28F 9/0131 165/69 |
| 2012/0267088 | A1* | 10/2012 | Lange | F28F 9/0131 165/181 |
| 2012/0312292 | A1* | 12/2012 | Bahl | F28F 9/0131 126/400 |
| 2012/0325448 | A1* | 12/2012 | Kim | F28F 9/0131 165/172 |
| 2014/0238649 | A1 | 8/2014 | Postma et al. | |
| 2018/0078997 | A1* | 3/2018 | Ujiie | F28F 9/0131 |

FOREIGN PATENT DOCUMENTS

| | | | |
|---|---|---|---|
| EP | 2960614 | A1 | 12/2015 |
| JP | S58208501 | A | 12/1983 |
| JP | 59007887 | A | 1/1984 |
| JP | 03211397 | A | 9/1991 |
| JP | 10220708 | A | 8/1998 |
| JP | 2001-235101 | A | 8/2001 |
| NL | 1035755 | C2 | 1/2010 |
| WO | WO-2018/083367 | A1 | 5/2018 |

OTHER PUBLICATIONS

Finnish Office Action for Application No. 20185466, dated Jan. 18, 2019, (7 pages), Finnish Patent and Registration Office, Tampere, Finland.

International Searching Authority, International Search Report and Written Opinion for International Application No. PCT/FI2019/050363, dated Aug. 8, 2019, European Patent Office, Rijswijk, Netherlands.

International Preliminary Examining Authority, International Preliminary Report On Patentability for International Application No. PCT/FI2019/050363, dated May 14, 2020, (50 pages), European Patent Office, Munich, Germany.

Japanese Office Action for Japanese Patent Application No. 2020-564918, dated Mar. 14, 2023, (27 pages), Japan Patent Office, Tokyo, Japan.

* cited by examiner

HEAT EXCHANGER WITH A BOND AND A METHOD FOR MANUFACTURING THE SAME

CROSS REFERENCE TO RELATED APPLICATIONS

This application is a National Stage Application, filed under 35 U.S.C. § 371, of International Application No. PCT/FI2019/050363, filed May 9, 2019, which international application claims priority to and the benefit of Finland Application No. 20185466, filed May 21, 2018; the contents of both of which as are hereby incorporated by reference in their entireties.

BACKGROUND

Related Field

The invention relates to methods for manufacturing tube heat exchangers. The invention relates to heat exchangers particularly suitable for fluidized bed boilers. The invention relates to heat exchangers suitable for circulating fluidized bed boilers. The invention relates to fluidized bed heat exchangers. The invention relates to a heat exchanger for a loopseal of a circulating fluidized bed boiler. The invention relates to particle coolers.

Description of Related Art

A fluidized bed heat exchanger is known from U.S. Pat. No. 9,371,987. A heat transfer tube of the fluidized bed heat exchanger comprises straight parts and curved parts, whereby the heat transfer tube is configured to meander. Long tubes are not mechanically rigid, whereby they need to be mechanically supported in use. In the prior art document, walls of a space isolated from the fluidized bed provide for mechanical support for the tubes. In the alternative, the tubes could be supported to a wall of a furnace. From the document U.S. Pat. No. 8,141,502 it is known to support the tubes from beneath over substantially their whole length.

However, a structure wherein the walls support the tubes is hard to manufacture. The wall supporting the tubes may be provided with suitable apertures for the tubes. However, in such a manufacturing method, the tube needs to be assembled from multiple pieces; at least the straight parts and the curved parts, which are welded together. Welding, even if a well-known process, is somewhat burdensome, since the heat transfer tube needs to withstand a pressure of the order of 120 bar and a temperature of the order of 600° C.

BRIEF SUMMARY

The present invention aims at providing a mechanical support for heat transfer tubes of a heat exchanger, which support can be easily manufactured. The support, i.e. a bond, is disclosed in the description. A heat exchanger with such a bond is disclosed in an independent claim. A method for manufacturing such a heat exchanger is disclosed in an independent claim. The bond is suitable for use with a heat transfer tube or tubes that are bent at some locations. The bond is suitable for use with a heat transfer tube or tubes that need not be assembled or further assembled.

To illustrate different views of the embodiments, three orthogonal directions Sx, Sy, and Sz are indicated in the figures. Preferably, in use, the direction Sz is substantially vertical and upwards. In this way, the direction Sz is substantially reverse to gravity. A direction $S_h$ in FIG. 10 refers to a horizontal direction, which is perpendicular to Sz.

DETAILED DESCRIPTION OF VARIOUS EMBODIMENTS

Figure 1A:
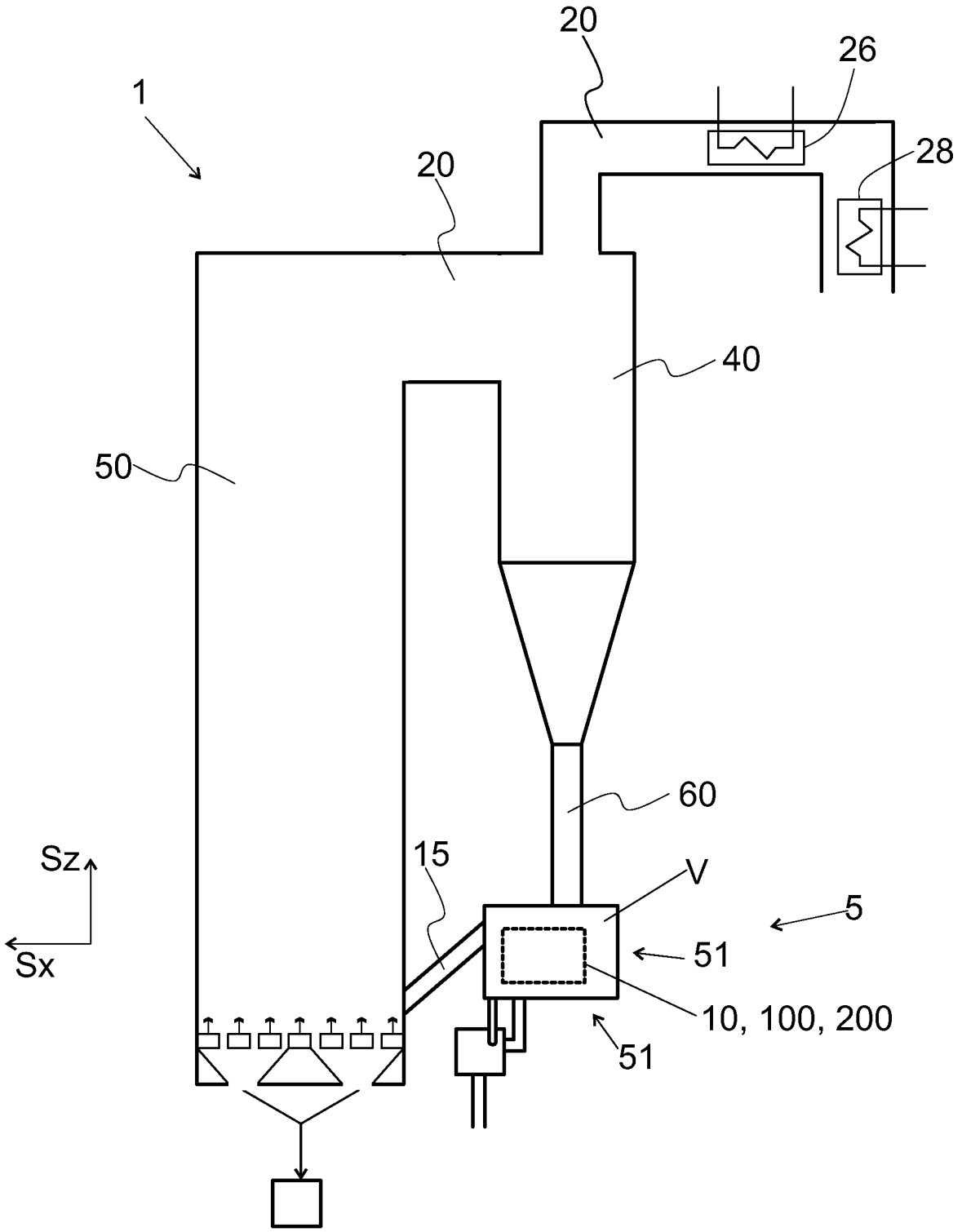
FIG. 1*a* shows a circulating fluidized bed boiler in a side view.

FIG. 1*a* shows a circulating fluidized bed boiler 1 in a side view. The circulating fluidized bed boiler 1 comprises a furnace 50, a cyclone 40, which is a means 40 for separating bed material from flue gas, and a loopseal 5. the loopseal 5 is configured to receive bed material from the cyclone 40. In FIG. 1*a*, a flue gas channel is indicated by the reference number 20. Flue gas is expelled from the furnace 50 via the flue gas channel 20.

Figure 1B:
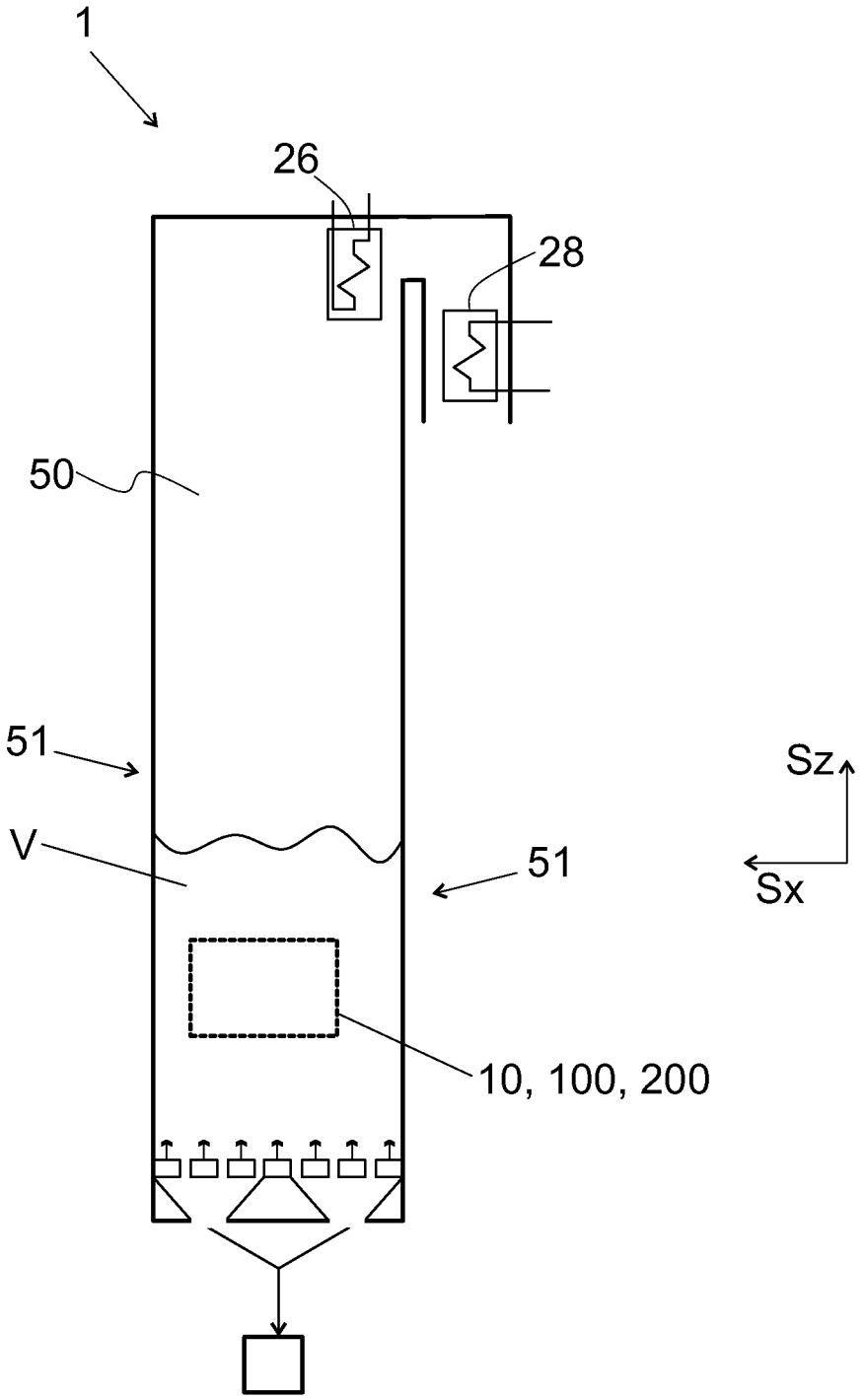
FIG. 1*b* shows a bubbling fluidized bed boiler in a side view.

FIG. 1*b* shows a bubbling fluidized bed boiler 1 in a side view. The bubbling fluidized bed boiler 1 comprises a furnace 50, and a flue gas channel 20.

Typically, the fluidized bed boiler 1 (bubbling or circulating) comprises flue gas heat exchangers 26, 28 within the flue gas channel 20. The flue gas heat exchangers 26, 28 are configured to recover heat from flue gases. Some of the flue gas heat exchangers may be superheaters 26 configured to superheat steam by recovering heat from flue gas. Some of the heat exchangers may be economizers 28 configured to heat and/or boil water by recovering heat from flue gas.

In a circulating fluidized bed boiler (FIG. 1*a*), bed material is conveyed from an upper part of the furnace 50 to the cyclone 40 in order to separate the bed material from gases. From the cyclone 40, the bed material falls through a channel 60 to a loopseal 5. In the loopseal 5, a layer of bed material is formed. The bed material is returned from the loopseal 5 to the furnace 50 via a pipeline 15. In the loopseal 5, the walls 51 of the loopseal 5 limit a volume V into which a fluidized bed of the circulating bed material is arranged. In a bubbling fluidized bed boiler (FIG. 1*b*), the bed material is fluidized in the furnace 50. Thus, the walls 51 of the furnace 50 limit a volume V into which a fluidized bed of the bed material is arranged.

In general, a fluidized bed boiler 1 comprises piping for heat transfer medium. In use, the heat transfer medium circulates in the piping and becomes heated by heat exchangers, in particular the flue gas heat exchangers 26, 28 and the fluidized bed heat exchanger 10. The piping forms a circulation for heat transfer medium. In the circulation, the same heat transfer medium may flow in between the flue gas heat exchangers 26, 28 and the fluidized bed heat exchanger 10. Typically the circulation is formed such that the heat exchange medium is first heated in the economizers 28 and thereafter in the superheaters 26. Moreover, after the superheaters 26, the heat exchange medium is heated in the fluidized bed heat exchanger 10. Thereafter, the medium (e.g. superheated steam) is typically conveyed to a steam turbine.

The present invention relates in particular to a structure of a heat exchanger and a method for manufacturing such a heat exchanger. In a preferably use, the heat exchanger is arranged in a fluidized bed, such as in the loopseal 5 of a circulating fluidized bed boiler or in the furnace of a bubbling fluidized bed boiler. In general, a heat exchanger comprises a number of tubes, in which a first heat transfer medium, such as water and/or steam, is configured to flow. Outside the tubes, second heat transfer medium, such as bed material, is configured to flow, whereby heat is transferred from the second heat transfer medium to the first heat transfer medium through a wall of the tube. The heat exchanger 10, which, when installed in a fluidized bed, forms a fluidized bed heat exchanger 10, can be manufactured a as a part of a boiler or as a spare part for the boiler. Thus, an embodiment concerns a heat exchanger 10. In addition, an embodiment concerns fluidized bed boiler 1.

In this description, the following terms are used:

A heat transfer tube refers to a tube. The heat transfer tube may be made from only one substantially homogeneous material, e.g. metal, such as steel. When considered feasible a heat transfer tube may is referred to as a "plain heat transfer tube" to distinct from a "coaxial heat transfer tube". A plain heat transfer tube may consist of some metal, since metals in general conduct heat well.

A coaxial heat transfer tube refers to an arrangement of heat transfer tubes, in which a laterally outermost heat transfer tube encircles an inner heat transfer tube. A coaxial heat transfer tube is an arrangement of heat transfer tubes (typically only two heat transfer tubes) that are mutually coaxial.

A straight part refers to such a part of a heat transfer tube (plain tube or coaxial tube), that has been obtained from a tube manufacturer, and has not been bent. Commonly, tube manufacturers supply straight rigid tubes. In terms of a radius of curvature, a radius of curvature $r_s$ (see FIG. 2*a*) of a central line of the straight part is at least 1 meter (1 m). A radius of curvature $r_s$ of a straight part may be infinite or substantially infinite.

A curved part refers to such a part of a heat transfer tube (plain or coaxial), that has been bent. In terms of a radius of curvature, a radius of curvature $r_c$ (see FIG. 2*a*) of a central line of the curved part is less than 1 meter (1 m). Preferably, a radius of curvature $r_c$ of a curved part is at least three times a diameter of the heat transfer tube.

Figure 2A:
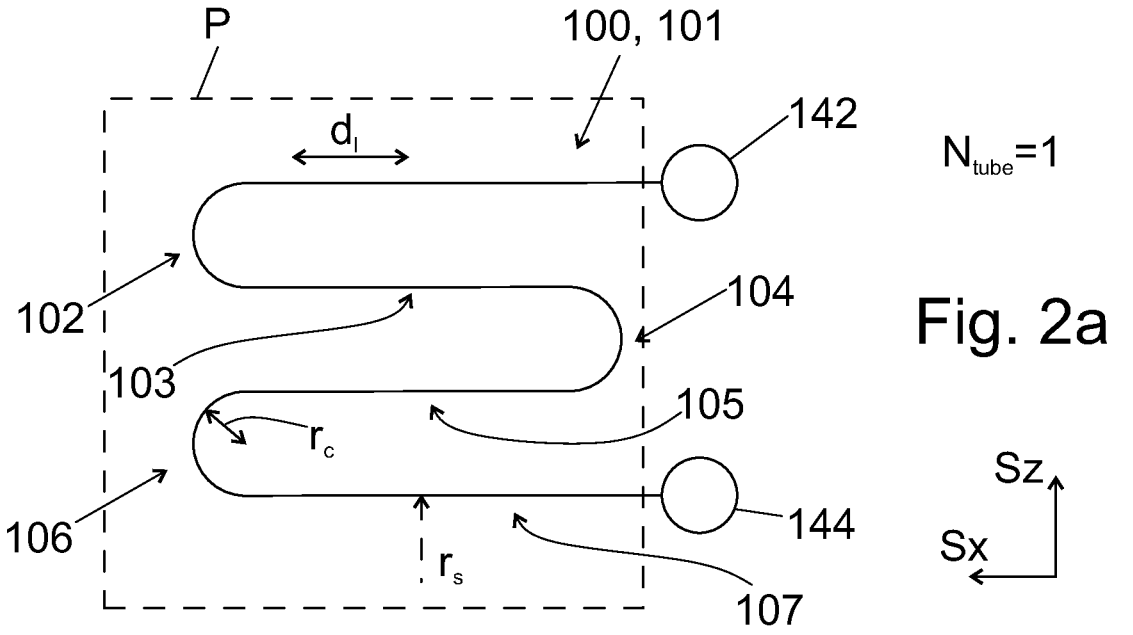
FIG. 2*a* shows a first heat transfer tube in a side view.

FIG. 2*a* shows a heat transfer tube 100, i.e. a first heat transfer tube 100 in a side view. A heat exchanger 10 of the present invention comprises a first heat transfer tube 100. As indicated in FIG. 2*a*, the first heat transfer tube 100 comprises a first primary straight part 101, a first primary curved part 102, a first secondary straight part 103, a first secondary curved part 104, a first tertiary straight part 105, and also a further (i.e. tertiary) curved part 106 and a further (i.e. quaternary) straight part 107. At least a curved part is left in between two straight parts of the tube 100 in the direction of extension of the tube such that the straight parts of the first heat transfer tube 100 extend parallel in a first plane P in a longitudinal direction $d_l$. In FIG. 2*a*, the direction of flow of heat transfer medium within the tube 100 in the first primary straight part 101 is reverse to the direction of flow of heat transfer medium within the tube in the first secondary straight part 103. This is also reverse to the direction of flow of heat transfer medium within the tube in the first tertiary straight part 105. FIG. 2*a* shows also a distributor header 142 configured to feed heat transfer medium into the first heat transfer tube 100 and optionally into other heat transfer tubes of the heat exchanger 10. FIG. 2*a* shows also a collector header 144 configured to collect heat transfer medium from the first heat transfer tube 100, and optionally from other heat transfer tubes of the heat exchanger 10.

Figure 2B:
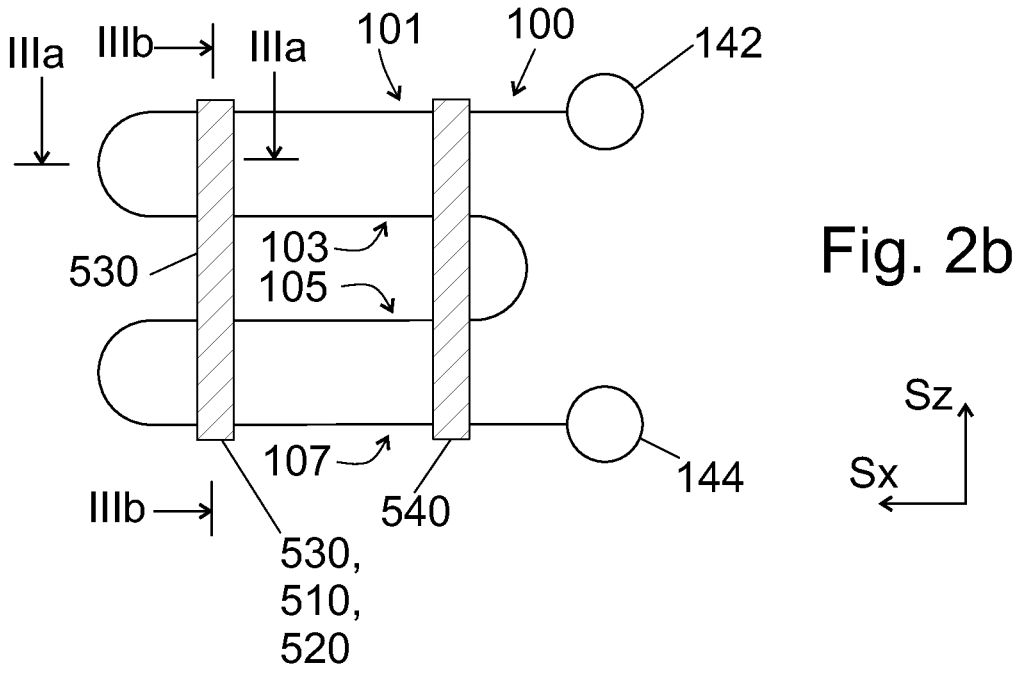
FIG. 2*b* shows the heat transfer tube of FIG. 2*a* and a bond bonding the straight parts together.
Figure 11A:
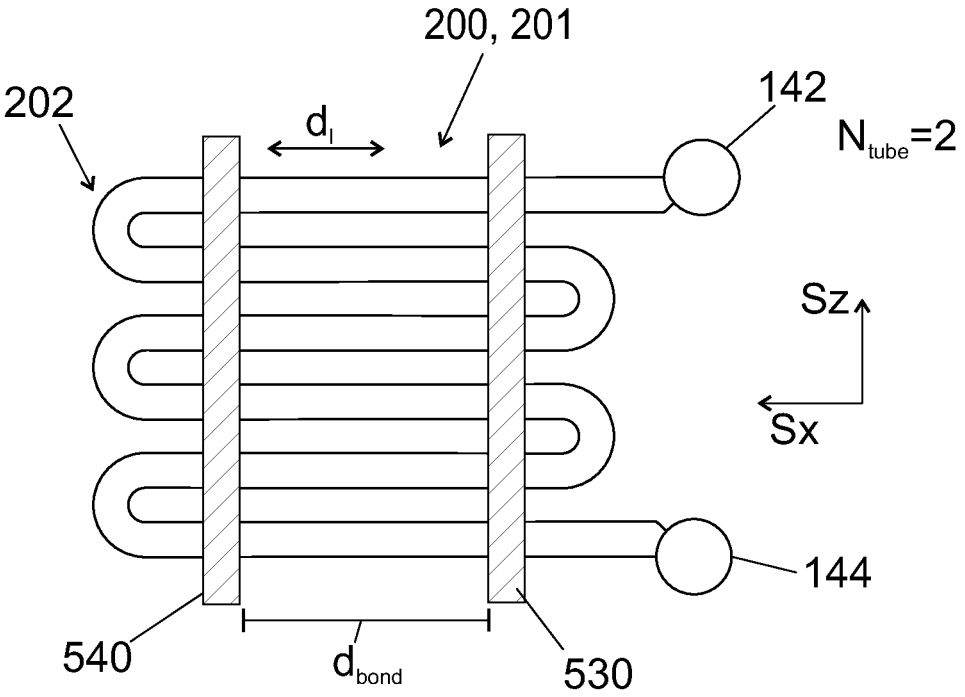
FIG. 11*a* shows, in a side view, an arrangement of two heat transfer tubes and two bonds supporting both the heat transfer tubes.

A heat exchanger 10 may be modular, i.e. insertable into e.g. a boiler 1 and removable therefrom. For reasons of handling such a heat exchanger 10, the heat transfer tube 100 is preferably mechanically supported. For this reason, a heat exchanger 10 is equipped with a first primary bond 530 as shown in FIG. 2*b*. Preferably, the heat exchanger 10 is equipped also with a first secondary bond 540 as shown in FIG. 2*b*. A distance $d_{bond}$ is left in between the first primary bond 530 and the first secondary bond in the longitudinal direction $d_l$, as indicated in FIG. 11*a*. The distance $d_{bond}$ may be e.g. at least 50 cm, such as at least 1 m. A sufficiently large distance improves the mechanical stability of the heat exchanger.

The first primary bond 530 and the first secondary bond 540 may be manufactured following the principles presented later in this application. They may be structurally identical. The first primary bond 530 binds at least two parts of at least one heat transfer tube together to support the heat transfer tube(s). In an embodiment, the first primary bond 530 is supported or configured to be supported to a supportive structure of a boiler. For example, the first primary bond 530 may be supported, e.g. connected, to a floor or a beam of a boiler in the space V. In an embodiment, the first primary bond 530 supported or configured to be supported to a supportive structure underneath the heat transfer tube(s) 100, 200. In such an embodiment, the bond 530 should bear a part of the weight of the heat transfer tubes.

Figure 3A:
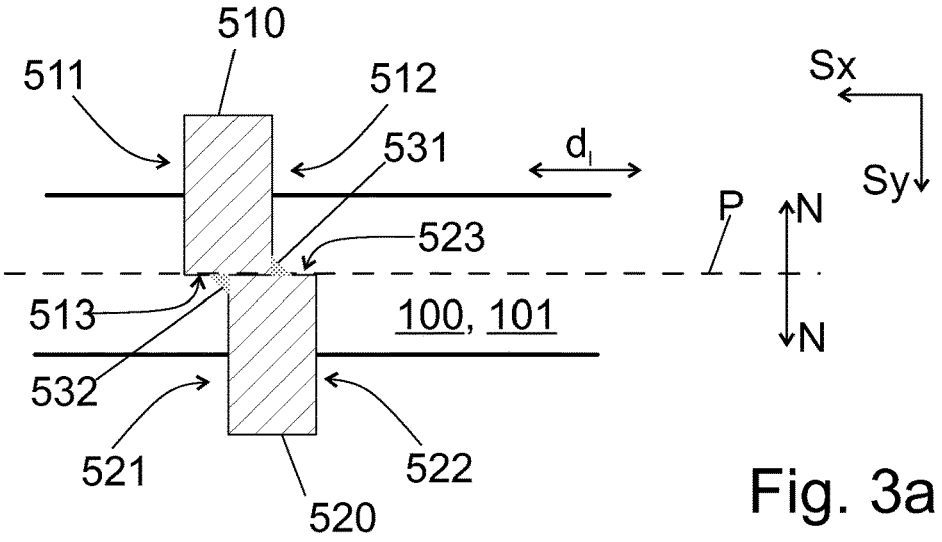
FIG. 3*a* shows the sectional view IIIa-IIIa of the heat transfer tube and bond of FIG. 2*b*.

The first primary bond 530 comprises a first primary bond part 510 and a first secondary bond part 520. FIG. 3*a* shows the sectional view IIIa-IIIa of FIG. 2*b*. Thus, in typical use, FIG. 3*a* is a top view of the first primary bond 530 and the first primary straight part 101 of the tube 100.

Figure 4A:
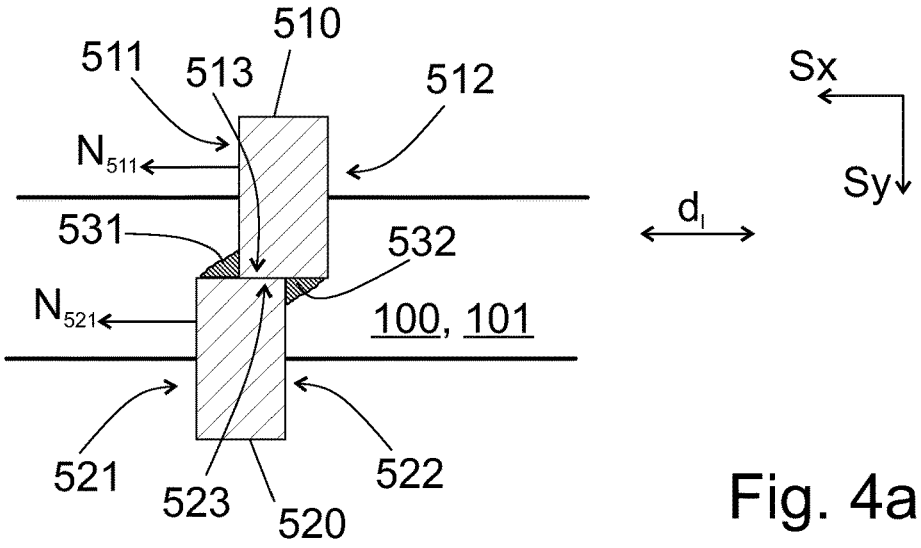
FIG. 4*a* shows, in a top view, a bond and a heat transfer tube, wherein a normal of the primary surfaces (511, 521) is parallel with the longitudinal direction of the heat transfer tube
Figure 4B:
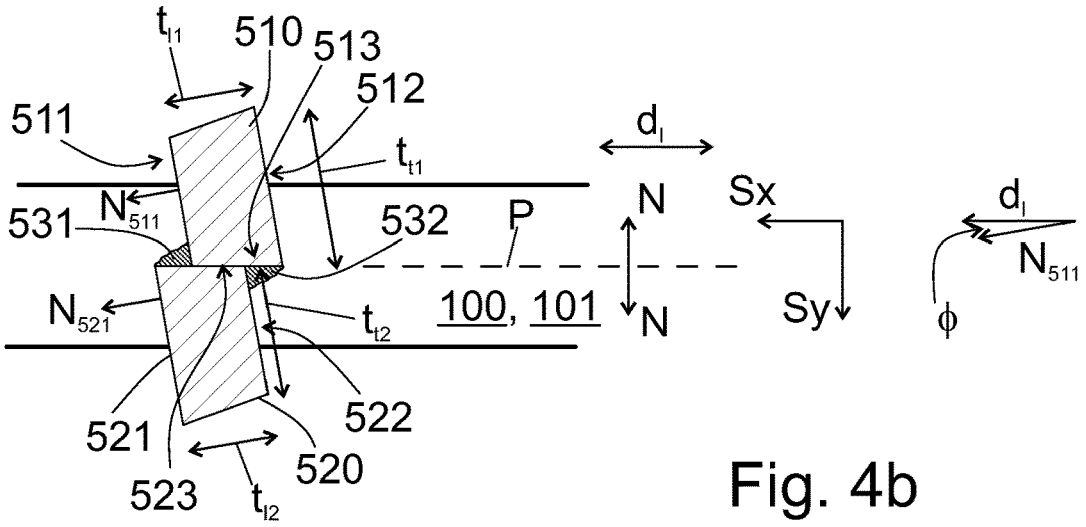
FIG. 4*b* shows, in a top view, a bond and a heat transfer tube, wherein a normal of the primary surfaces (511, 521) is not parallel with the longitudinal direction of the heat transfer tube.

Referring to FIG. 3*a*, the first primary bond part 510 comprises a first primary surface 511. In an embodiment, the whole first primary surface 511 is planar. In the embodiment of FIG. 3*a*, the first primary surface 511 faces to the longitudinal direction $d_l$ of the first straight parts (101, 103) of the tube 100. However, as indicated in FIG. 4*b*, this is not necessary. The first primary bond part 510 comprises a first secondary surface 512 opposite the first primary surface 511. In an embodiment, the whole first secondary surface 512 is planar. In FIG. 3*a*, the first secondary surface 512 faces to a direction $-d_l$, which is reverse to the longitudinal direction $d_l$. The first primary bond part 510 comprises a first tertiary surface 513. As will be discussed later, the first tertiary surface 513 may be manufactured by cutting. Thus, an angle between a normal of the first tertiary surface 513 and a normal of the first primary surface 511 depends on how the first primary bond part 510 has been manufactured, e.g. cut from a plate.

The first primary bond part 510 and the first straight parts (101, 103) of the tube 100 are arranged with respect to each other in such a way that a part the first tertiary surface 513 faces towards the first primary straight part 101 and a part the first tertiary surface 513 faces towards the first secondary straight part 103. In particular, surfaces of the holes 514, 515 will face the straight parts 101, 103, as detailed below. This has the effect that the parts of the tube 100 can be fitted to the holes 514, 515. Thus, at least a part of the first tertiary surface 513 faces in a direction of a normal N of the first plane P. The first tertiary surface 513 connects the first primary surface 511 and the first secondary surface 512. Preferably, at each point of the first tertiary surface 513, a tangential direction of the first tertiary surface 513 is a direction within the plane P, as indicated in FIG. 3*a*. However, apart from the surfaces of the holes 514, 515, the first tertiary surface may be arranged at a different angle relative to the plane P (not shown). Still, as indicated in FIGS. 4*a* and 4*b*, preferably, all planar parts of first tertiary surface 513 faces in a direction of a normal N of the first plane P. Preferably also, at all points, the first tertiary surface 513 has a normal that belongs to a plane, of which normal is unidirectional with the longitudinal direction $d_l$ (see FIGS. 4*a* and 4*b*).

Figure 3B:
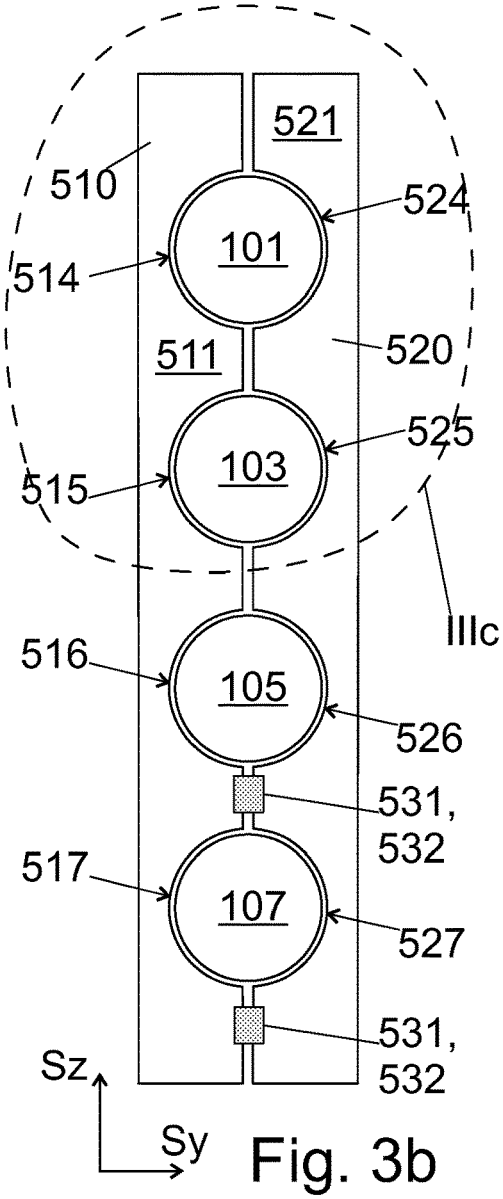
FIG. 3*b* shows the sectional view IIIb-IIIb of the heat transfer tube and bond of FIG. 2*b*.
Figure 3C:
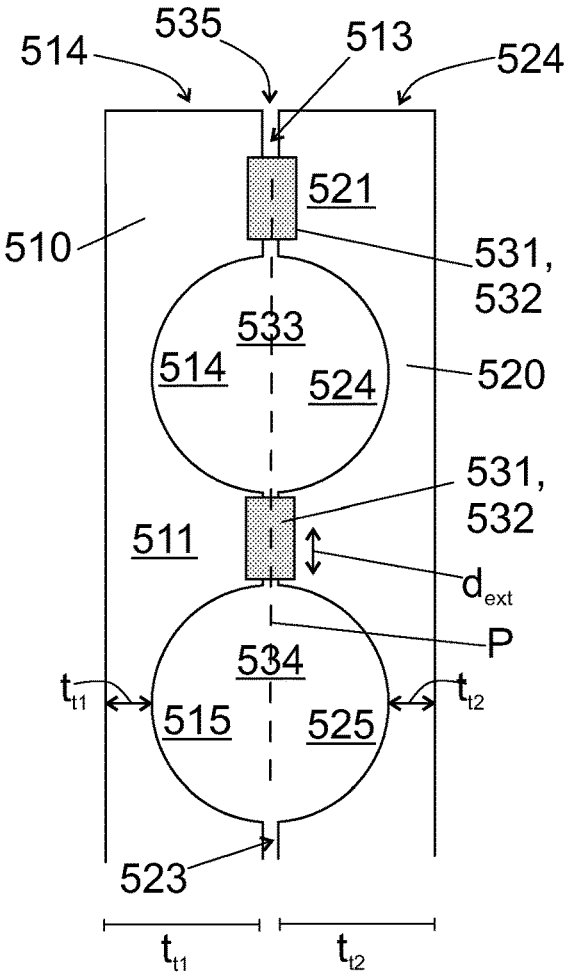
FIG. 3*c* shows the part IIIc of FIG. 3*b* in more detail.

Referring now to FIGS. 3*b* and 3*c*, a first primary hole 514 is arranged on the on the first tertiary surface 513. The first primary hole 514 is configured to receive a part of the first primary straight part 101. Thus, the shape of the first primary hole 514 is adapted, i.e. fitted, to the outer surface of the first primary straight part 101. In this way, the first primary bond part 510 limits, on the first tertiary surface 513, a first primary hole 514 extending through the first primary bond part 510 from the first primary surface 511 to the first secondary surface 512 in the longitudinal direction $d_l$. Moreover, a part of the first primary straight part 101 is arranged into the first primary hole 514, as indicated in FIG. 3*b*. The first primary hole 514 forms a part of a first primary aperture 533.

In a similar manner, a first secondary hole 515 is arranged on the on the first tertiary surface 513. The first secondary hole 515 is configured to receive a part of the first secondary straight part 103. Thus, the shape of the first secondary hole 515 is adapted, i.e. fitted, to the outer surface of the first secondary straight part 103. In this way, the first primary bond part 510 limits, on the first tertiary surface 513, a first secondary hole 515 extending through the first primary bond part 510 from the first primary surface 511 to the first secondary surface 512 in the longitudinal direction $d_l$. Moreover, a part of the first secondary straight part 103 is arranged into the first secondary hole 515, as indicated in FIG. 3*b*. The first secondary hole 515 forms a part of a first secondary aperture 534.

The holes 514 and 515, and also 524, 525, which will be defined later, are indentations on the surface 513 (or 523), defining apertures of the bond 530 for receiving a part of a heat transfer tube; in particular a part of a straight part thereof. The shape(s) of the hole(s) is/are adapted, i.e. fitted, to the corresponding part(s) of a tube or tubes in such a way, that in use, essentially no gap is left in between the tertiary surface 513, 523 and an outer surface of the tube. For reasons of manufacturing tolerance, a gap having a width of at most 0.5 mm may be left at some points in between a surface of a hole (514, 515, 524, 525) and an outer surface of a part (101, 103) of a tube 100. Thus, even if FIG. 3*b* shows a gap in between the tube parts (101, 103) and the holes (514, 515, 524, 525) for reasons of presentation, preferably no such gap is present in the heat exchanger. A small gap or no gap at all improves the wear resistance of the tube 100, since in such case movements between the bond parts 510, 520 and the tube parts 101, 103 are reduced, which reduces wear of the tube 100 or tubes 100, 200, 300, 400.

In order to bind the first straight parts (101, 103) together, the first primary bond part 510 extends from the first secondary hole 515 to the first primary hole 514.

Referring to FIG. 3*a*, the first secondary bond part 520 comprises a second primary surface 521. In an embodiment, the whole second primary surface 521 is planar. In FIG. 3*a* the second primary surface 521 faces to the longitudinal direction $d_l$ of the first straight parts (101, 103) of the tube 100. However, as indicated above, this is not necessary. The first secondary bond part 520 comprises a second secondary surface 522 opposite the second primary surface 521. In an embodiment, the whole second secondary surface 522 is planar. Thus, in FIG. 3*a*, the second secondary surface 522 faces to a direction $-d_l$, which is reverse to the longitudinal direction $d_l$. The first secondary bond part 520 comprises a second tertiary surface 523. The first secondary bond part 520 and the first straight parts (101, 103) of the tube 100 are arranged with respect to each other in such a way that at least parts of the second tertiary surface 523 face towards the first straight parts (101, 103). At least parts of the second tertiary surface 523 also face in a direction of a normal N of the first plane P. The second tertiary surface 523 connects the second primary surface 521 and the second secondary surface 522. Preferably, at each point of the second tertiary surface 523, a tangential direction of the second tertiary surface 523 is a direction within the plane P, as indicated in FIG. 3*a*. As for the first tertiary surface 513, preferably, all planar parts of the second tertiary surface 523 faces in a direction of a normal N of the first plane P. Preferably also, at all points, the second tertiary surface 523 has a normal that belongs to a plane, of which normal is unidirectional with the longitudinal direction $d_l$ (see FIGS. 4*a* and 4*b*).

Referring now to FIGS. 3*b* and 3*c*, a second primary hole 524 is arranged on the on the second tertiary surface 523. The second primary hole 524 is configured to receive a part of the first primary straight part 101. Thus, the shape of the second primary hole 524 is adapted to the outer surface of the first primary straight part 101. In this way, the first secondary bond part 520 limits, on the second tertiary surface 523, a second primary hole 524 extending through the first secondary bond part 520 from the second primary surface 521 to the second secondary surface 522 in the longitudinal direction di. Moreover, a part of the first primary straight part 101 is arranged into the second primary hole 524, as indicated in FIG. 3*b*. The second primary hole 524 forms a part of the first primary aperture 533.

In a similar manner, a second secondary hole 525 is arranged on the on the second tertiary surface 523. The second secondary hole 525 is configured to receive a part of the first secondary straight part 103. Thus, the shape of the second secondary hole 525 is adapted to the outer surface of the first secondary straight part 103. In this way, the first secondary bond part 520 limits, on the second tertiary surface 523, a second secondary hole 525 extending through the first secondary bond part 520 from the second primary surface 521 to the second secondary surface 522 in the longitudinal direction di. Moreover, a part of the first secondary straight part 103 is arranged into the second secondary hole 525, as indicated in FIG. 3*b*. The second secondary hole 525 forms a part of a first secondary aperture 534.

In order to bind the first straight parts (101, 103) together, the first secondary bond part 520 extends from the second secondary hole 525 to the second primary hole 524.

In the heat exchanger 10, the first primary bond part 510 has been welded to the first secondary bond part 520 to form a first primary bond 530 that bonds the parts of the first heat exchanger tube 100. When welded together, the first primary hole 514 and the second primary hole 524 in combination form the first primary aperture 533 of the first primary bond 530, through which the first primary straight part in particular 101 of the heat transfer tube 100 extends. A shape of the first primary aperture 533 is adapted to a shape of an outer surface of the straight part 101 of the heat transfer tube 100. In a similar manner, the first secondary hole 515 and the second secondary hole 525 in combination form a first secondary aperture 534 of the first primary bond 530, through which the straight part 103 of the heat transfer tube 100 extends. A shape of the first secondary aperture 534 is adapted to a shape of the outer surface of the straight part 103 of the heat transfer tube 100. In this way, in an embodiment, a curved part (e.g. 102) of the first heat transfer tube 100 does not extend through the first primary bond 530. In this way, in an embodiment, a curved part (e.g. 102) of the first heat transfer tube 100 does not extend within the bond 530.

As indicated above and in FIG. 4*a*, in the embodiment, the first primary surface 511 has a normal $N_{511}$ that is parallel with the longitudinal direction $d_l$ of the first straight parts (101, 103) of the tube 100. Such a structure may be manufactured e.g. by forming the first tertiary surface 513 by cutting from a plate 500 in a direction of a normal on the plate 500. However, the first tertiary surface 513 may be cut at a different angle. In addition or alternatively, if the first tertiary surface 513 is cut by using a fluid jet, the first tertiary surface 513 is not perpendicular to the main surface 501 of the plate 500 (see FIG. 12). Referring to FIG. 4*b*, in such a case, the first primary surface 511 has a normal $N_{511}$ that forms an angle $\phi$ with the longitudinal direction $d_l$ of the first straight parts (101, 103) of the tube 100. However, preferably the normal $N_{511}$ of the first primary surface 511 is substantially parallel with the longitudinal direction $d_l$ of the first straight parts (101, 103) of the tube 100. More specifically in an embodiment, [i] the surface normal $N_{511}$ is parallel with the longitudinal direction $d_l$ or [ii] the surface normal $N_{511}$ forms an angle $\phi$ with the longitudinal direction $d_l$, wherein the angle $\phi$ is less than 45 degrees, such as less than 30 degrees or less than 15 degrees, preferably less than 5 degrees. A small angle makes it easier to assemble the bond 530.

As shown in FIG. 2*b*, preferably the heat exchanger 10 comprises a first secondary bond 540. The first secondary bond 540 may be manufactured in a similar manner as the first primary bond 530. Also the first secondary bond 540 is configured to bind together at least the first primary straight part 101 and the first secondary straight part 103. In FIG. 2*b*, the first secondary bond 540 binds also the first tertiary straight part 103 and the first quaternary straight part 107 together.

Figure 12:
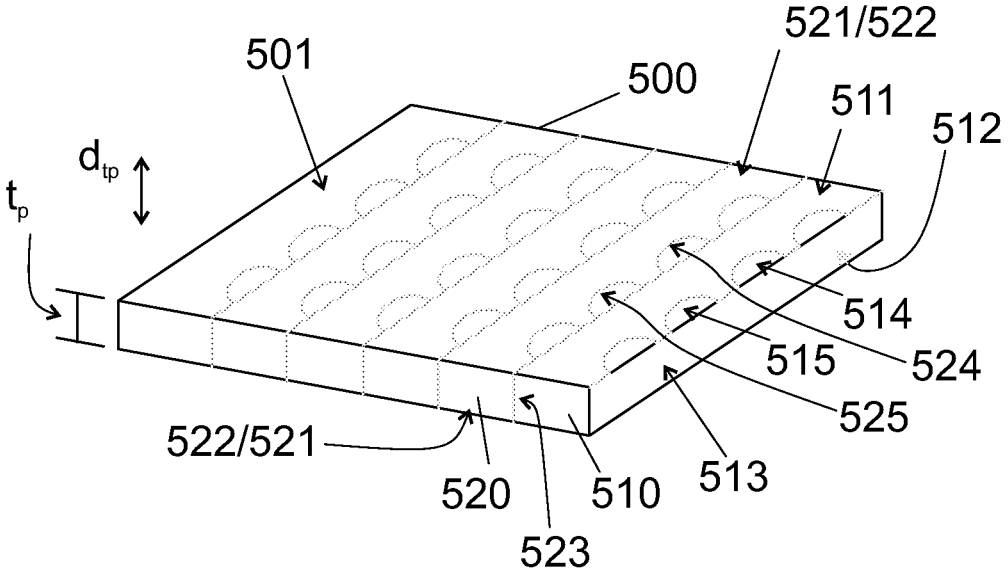
FIG. 12 shows a plate from which parts of the bonds can be cut, and cutting lines for the cutting.

When manufacturing such a heat exchanger 10, a first heat transfer tube 100 as detailed above and/or below is arranged available. The tube 100 may be manufactured e.g. by bending or the tube 100 may be e.g. bought. The first primary bond part 510 and the first secondary bond part 520 may be cut from a plate 500, as indicated in FIG. 12. The plate 500 has a thickness $t_p$. The thickness $t_p$ is oriented in a direction $d_{tp}$ of thickness $t_p$ of the plate 500, as shown in FIG. 12. Cutting lines are shown in FIG. 12 in grey colour. When cut through the lines, the first primary bond part 510 and the first secondary bond part 520 are formed. These parts are shown in FIG. 12. As indicated above, the cutting lines may extend through the plate 500 in a direction of the thickness $t_p$ of the plate 500, or the cutting lines may be arranged at an angle relative to the direction of the thickness $t_p$. Naturally, it would be possible to cut the first primary bond part 510 from the plate 500 and the first secondary bond part 520 from another plate.

Initially the plate 500 has a main surface 501, which has a surface normal that is parallel to direction $d_{tp}$ of thickness of the plate 500. Typically, the main surface 501 of the plate 501 is planar. In addition, typically a surface opposite to the main surface 501 is also planar. Since the bond 530 needs to have sufficient mechanical strength, the first primary bond part 510 is cut from the plate 500 such that a part of the main surface 501 forms either the first primary surface 511 or the first secondary surface 512. At least a part of the first tertiary surface 513 is formed by said cutting. In an embodiment, the resulting first tertiary surface faces in a direction that is perpendicular or substantially perpendicular to the direction $d_{tp}$ of thickness of the plate 500. The term "substantially perpendicular" may refer to an angle of (at most 90 degrees and) more than 45 degrees, such as more than 60 degrees or more than 75 degrees, preferably more than 85 degrees; in line with the aforementioned angle $\phi$. While forming at least a part of the first tertiary surface 513, also the first primary hole 514 and the first secondary hole 515 are formed by the cutting. As a result, the method comprises forming a first primary hole 514 that is configured to receive a part of the first primary straight part 101 of the first heat transfer tube 100. The shape of the hole 514 is adapted to the surface of the part 101 as discussed above. Moreover, method comprises forming a first secondary hole 515 that is configured to receive a part of the first secondary straight part 103 of the first heat transfer tube 100. The shape of the hole 515 is adapted to the surface of the part 103 as discussed above.

The first secondary bond part 520 is cut from the plate 500 (or a second plate) in a similar manner. The first secondary bond part 520 is cut from the plate 500 such that a part of the main surface 501 (or a main surface of the second plate) forms either the second primary surface 521 or the second secondary surface 522. Moreover, at least a part of the second tertiary surface 523 is formed by said cutting. In an embodiment, the resulting second tertiary surface faces in a direction that is perpendicular or substantially perpendicular to the direction $d_{tp}$ of thickness of the plate 500 or the second plate. The term "substantially perpendicular" may refer to an angle of (at most 90 degrees and) more than 45 degrees, such as more than 60 degrees or more than 75 degrees, preferably more than 85 degrees; in line with the aforementioned angle $\phi$. While forming at least a part of the second tertiary surface 523, also the second primary hole 524 and the second secondary hole 525 are formed by the cutting. As a result, the method comprises forming a second primary hole 524 that is configured to receive a part of the first primary straight part 101 of the first heat transfer tube 100. The shape of the hole 524 is adapted to the surface of the part 101 as discussed above. Moreover, method comprises forming a second secondary hole 525 that is configured to receive a part of the first secondary straight part 103 of the first heat transfer tube 100. The shape of the hole 515 is adapted to the surface of the part 103 as discussed above.

After forming said holes 514, 515, 524, 525, parts of the straight parts 101, 103 are arranged in the holes as indicated in FIG. 3*b*. Consequently, in an embodiment the tube 100 and the parts 510, 520 are arranged in such a way that a direction of thickness of the first primary bond part 510 and the longitudinal direction $d_l$ are parallel or form the aforementioned angle $\phi$. Moreover, a direction of thickness of the first secondary bond part 520 and the longitudinal direction $d_l$ are parallel or form an angle of e.g. less than 45 degrees in line with what has indicated for the angle $\phi$. As indicated in FIG. 12, during cutting, the direction of thickness of the first primary bond part 510 is parallel to the direction $d_{tp}$ of the plate 500. Moreover, during cutting, the direction of thickness of the first secondary bond part 520 is parallel to the direction $d_{tp}$ of the plate 500 of the second plate.

Thereafter, the first primary bond part 510 is welded to the first secondary bond part 520 to form the first primary bond 530. The first primary bond 530 bonds at least the straight parts (101, 103) of the first heat exchanger tube 100 together. A first secondary bond 540 may be manufactured in a similar manner.

The plate 500 may be cut by using a laser. In addition or alternatively, the plate 500 may be cut by using a fluid jet, e.g. a liquid jet or a gas jet. The effect of a fluid jet may be improved by using abrasive particles, such as sand. Using a fluid jet for cutting may have the effect that the tertiary surface 513 is not perpendicular to the first surface 511.

Preferably, the plate 500 comprises weldable metal having a melting point of at least 1000° C. Such metals are typically mechanically strong. Examples of suitable such metals include steel, such as austenitic steel. In a heat exchanger 10, the bond parts 510, 520 comprise such a material as discussed for the plate 500.

To have a sufficient mechanical stability, preferably, the thickness $t_p$ of the plate is from 15 mm to 40 mm. Correspondingly and with reference to FIG. 5*a*, in an embodiment of the heat exchanger 10, the first primary bond part 510 has a first primary thickness $t_{l1}$ in a direction of a normal $N_{511}$ of the first primary surface 511, wherein the first primary thickness $t_{l1}$ is from 15 mm to 40 mm. When the first primary bond part 510 is made from a plate 500, the first primary thickness $t_{l1}$ is constant. Moreover, the first secondary bond part 520 has a second primary thickness $t_{l2}$ in a direction of a normal $N_{521}$ of the second primary surface 521, wherein the second primary thickness $t_{l2}$ is from 15 mm to 40 mm. When the first secondary bond part 520 is made from the plate 500 or another plate, the second primary thickness $t_{l2}$ is constant. When the bond parts 510, 520 are made from the same plate 500, the first primary thickness $t_{l1}$ equals the second primary thickness $t_{l2}$. However, as indicated above, the parts 510, 520 need not be made of the same plate 500.

The mechanical stability can be affected also by selecting the thickness and other dimensions of the bond parts 510, 520. However, if the bond parts 510, 520 are large, different parts of heat transfer tubes must be are arranged far away from each other, whereby the size of the heat exchanger 10 increases. Typically, a ratio of the surface area of the heat transfer tubes 100, 200, 300, 100*b*, 200*b* to the volume of the heat exchanger 10 is maximized for good heat recovery. From point of view of these considerations, the aforementioned thickness has been found particularly suitable, in particular, when the bond 530 comprises steel.

As for the other dimensions of the bond parts 510, 520, also the other dimensions should be reasonable large to have the mechanical supportive function and reasonably small for a compact heat exchanger. In particular, in some uses, the bond(s) 530 and/or 540 are used to mechanically support the tube(s) 100, 200, 300, 400 from below and against gravitational forces of the tube(s). Therefore, a thin, e.g. plate-like, bond would not provide sufficient support. However, if the bond(s) 530, 540 are used to hang the tubes, a thinner bond or bonds could suffice. Thus, and with reference to FIG. 5, in a preferable embodiment, in between the first primary hole 514 and the first secondary hole 515, the first primary bond part 510 has a first secondary thickness $t_{t1}$ in a direction that is perpendicular to a normal $N_{511}$ of the first primary surface 511 and forms a minimum angle with a normal N of the first plane P. It is noted that all directions of the first primary surface 511 are perpendicular to the normal $N_{511}$. Moreover, each one of the directions of the first primary surface 511 forms an angle (optionally zero degrees) with a normal N of the first plane P. Thus, only one direction of the first primary surface 511 form a minimum angle (optionally zero degrees) with a normal N of the first plane P. The directions of thicknesses are clarified in FIGS. 4*b* and 5*a*.

The first secondary thickness $t_{t1}$ needs not be constant, but may depend e.g. on the level (e.g. height) of measuring the thickness; as indicated e.g. in FIG. 3*c*. From point of view of mechanical support, a minimum $t_{t1,min}$ of the first secondary thickness $t_{t1}$, i.e. a minimum first secondary thickness $t_{t1,min}$ may determine the supportive capability of the bond 530. Therefore, in an embodiment the minimum first secondary thickness $t_{t1,min}$ is from 10 mm to 50 mm, preferably from 15 mm to 50 mm. The first secondary thickness $t_{t1}$ may depend on location, as seen from FIG. 3*c*. Thus, in an embodiment, in between the first primary hole 514 and the first secondary hole 515, the first primary bond part 510 has only such first secondary thicknesses $t_{t1}$ that are from 10 mm to 50 mm. In other words, a maximum $t_{t1,max}$ of the first secondary thickness $t_{t1}$ may be at most 50 mm. This helps to keep the manufacturing costs at reasonable level and the heat exchanger reasonably small.

In a similar manner, in a preferable embodiment, in between the second primary hole 524 and the second secondary hole 525, the first secondary bond part 520 has a second secondary thickness $t_{t2}$ in a direction that is perpendicular to a normal $N_{521}$ of the second primary surface 521 and forms a minimum angle with a normal N of the first plane P. The second secondary thickness $t_{t2}$ has a minimum value, minimum second secondary thickness $t_{t2,min}$ and a maximum value $t_{t2,max}$. In an embodiment, the minimum second secondary thickness $t_{t2,min}$ is from 10 mm to 50 mm, preferably from 15 mm to 50 mm. The second secondary thickness $t_{t2}$ may depend on location. Thus, in an embodiment, in between the second primary hole 524 and the second secondary hole 525, the first secondary bond part 520 has only such secondary thicknesses $t_{t2}$ that are from 10 mm to 50 mm. In other words, a maximum of the second secondary thickness $t_{t2,max}$ may be at most 50 mm.

Regardless of whether the bond parts 510, 520 are made from the same plate 500 or from different plates, the second thicknesses ($t_{t1}$, $t_{t2}$) may be different from each other. However, preferably the second primary thickness $t_{t1}$ equals the second secondary thickness $t_{t2}$ at least locally, i.e. at a certain location (e.g. level in the Sz direction, see FIG. 3*c*). This prevents the bond 530, 540 from warping in use; or at least diminishes the tendency or warping in a hot environment.

The bond parts 510, 520 are most preferably welded together as indicated in FIGS. 3*a*, 3*b*, 3*c*, 4*a*, 4*b*, 5*a*, and 6*a*. Preferably, the heat exchanger 10 comprises a first welding joint 531 that joins the second tertiary surface 523 to the first primary surface 511 (see FIG. 4*a*) or the first secondary surface 512 (see FIG. 3*a*). Preferably, the heat exchanger 10 comprises a second welding joint 532 that joins the first tertiary surface 513 to the second secondary surface 522 (see FIG. 4*a*) or the second primary surface 521 (see FIG. 3*a*). The welding joints 531, 532 are evidence of welding. Thus, an embodiment of the method comprises welding the second tertiary surface 523 to the first primary surface 511 or the first secondary surface 512. Furthermore, an embodiment of the method comprises welding the first tertiary surface 513 to the second secondary surface 522 or the second primary surface 521. It has been found that welding is this manner also prevents the bond 530, 540 from warping in use; or at least diminishes the tendency or warping in a hot environment.

In order to have sufficiently strong joint in between the bond parts 510, 520, the welding joins 531, 532 should be sufficiently long. Therefore, and with reference to FIG. 3*c*, in an embodiment the first welding joint 531 extends in a direction $d_{ext}$ that is a direction within the first plane P and perpendicular to the longitudinal direction $d_l$. In an embodiment the first welding joint 531 extends in between the first primary straight part 101 and the first secondary straight part 103. Preferably the first welding joint 531 extends in this direction, and optionally also in the aforementioned location, at least 5 cm. In a similar manner, in an embodiment, the second welding joint 532 extends in the direction $d_{ext}$. In an embodiment, the second welding joint 532 extends in between the first primary straight part 101 and the first secondary straight part 103. Preferably the second welding joint 532 extends in this direction, and optionally also in the aforementioned location, at least 5 cm. In a preferable embodiment, the welding joints 531, 532 do not extend fully to either of the straight parts 101, 103 of the tube 100. Correspondingly, preferably, a distance of at least 1 mm is left in between the first welding joint 531 and both the straight parts 101, 103 and a distance of at least 1 mm is left in between the second welding joint 532 and both the straight parts 101, 103. This has the effect that the welding of the bond parts 510, 520 together does not affect the mechanical properties, in particular the capability of withstanding high pressure, of the heat transfer tube 100.

Figure 5A:
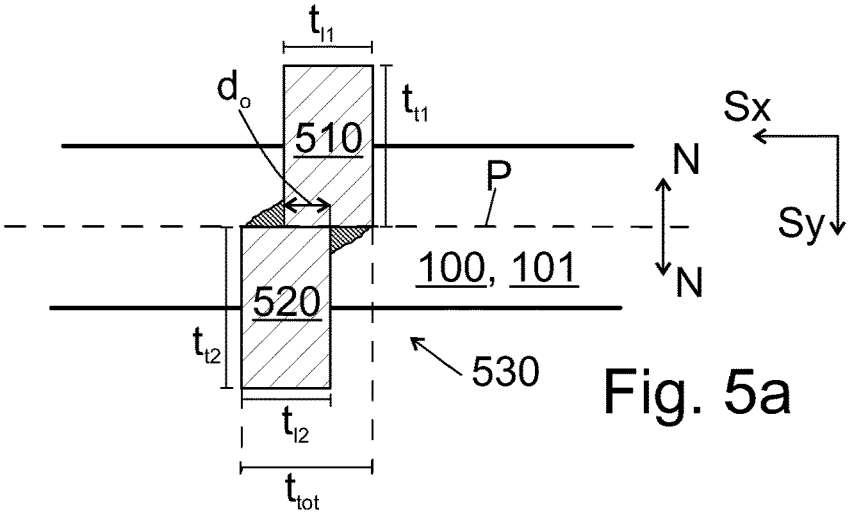
FIG. 5*a* shows, in a top view, a bond and a heat transfer tube, wherein bond parts partially overlap in a direction of a normal N of the plane P.

As indicated above, such welding diminishes warping of the bond. In addition to the measures of the bond parts and the type of welding, the tendency of warping can be affected by the relative positioning of the first primary bond part 510 and the second primary bond part 520. Referring to FIG. 5*a*, a length $l_{tot}$ of the first primary bond 530 in a direction of a normal $N_{511}$ of the first primary surface 511 is defined by the first primary thickness $t_{l1}$, the second primary thickness $t_{l2}$, and the overlapping distance $d_o$. Mathematically: $l_{tot}=t_{l1}+t_{l2}-d_o$. Typically the normals $N_{511}$ and $N_{512}$ of the primary surfaces 511, 521 are unidirectional.

Figure 5B:
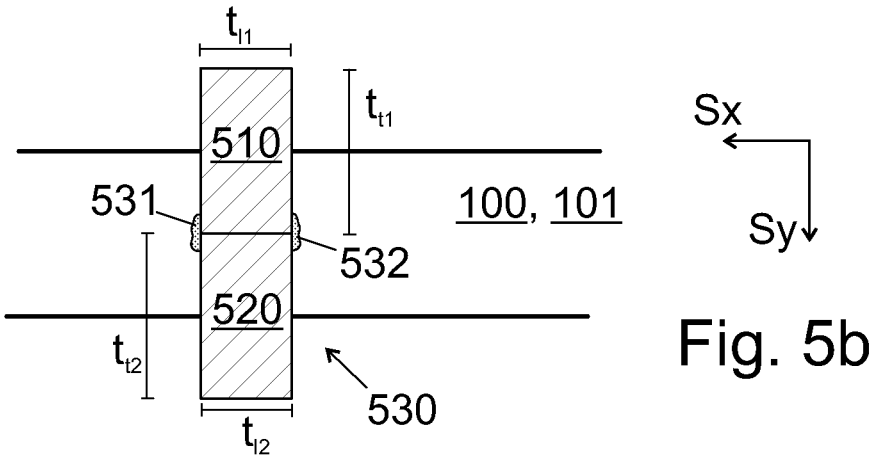
FIG. 5*b* shows, in a top view, a bond and a heat transfer tube, wherein bond parts fully overlap in a direction of a normal N of the plane P.

When there is at least partial overlap, as in FIGS. 5*a* and 5*b*, a part of the first tertiary surface 513 faces a part of the second tertiary surface 523. If there was a full overlap, as in FIG. 5*b*, the overlapping distance $d_o$ would equal $l_{tot}$. In such a case, the aforementioned surfaces would not be welded to each other. In contrast, in such a case, e.g. the surface 512 would be welded to the surface 522 and the surface 511 would be welded to the surface 521 (see FIG. 4*a* for the surfaces). However, such welding would be harder to perform in a reliable manner. Thus, at least a risk of warping, would be increased. Moreover, it has been found that, if welded in this manner warping of the bond 530 would occur. Warping of the bond 530 is use may be a result of thermal expansion of the bond parts 510, 520 and the tube(s) 100, 200, 300, 400.

Figure 5C:
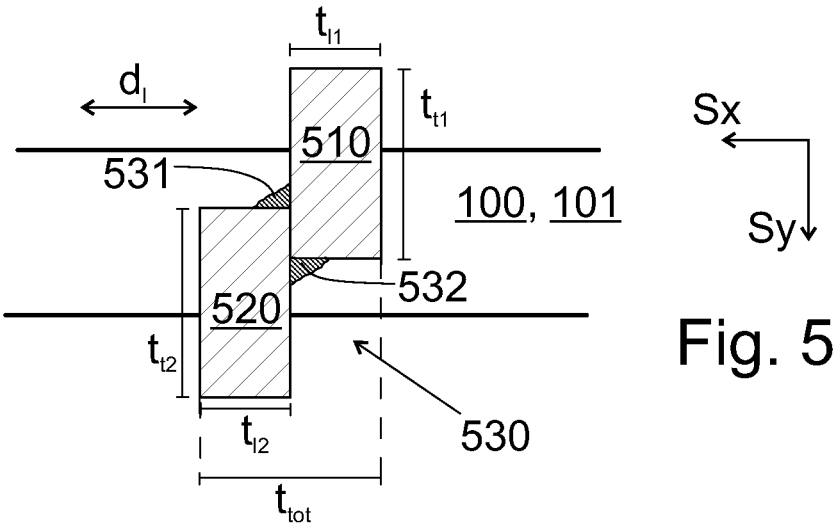
FIG. 5*c* shows, in a top view, a bond and a heat transfer tube, wherein bond parts do not overlap in a direction of a normal N of the plane P.

If there was no overlap, as in FIG. 5*c*, the overlapping distance $d_o$ would be zero, and correspondingly the thickness $l_{tot}$ of the bond 530 would be the sum of thicknesses of its parts. Moreover, as indicated in FIG. 5*c*, not even a part of the first tertiary surface 513 faces a part of the second tertiary surface 523. In such a case, the aforementioned surfaces would be welded to each other. This solution is as easily manufacturable as the one of FIG. 5*a*. However, it has been found that the warping of the bond is minimized by a partial overlap (FIG. 5*a*), and is the worst by a full overlap (FIG. 5*b*). Therefore, preferably the overlapping distance $d_o$ is not zero. In other words, preferably a total thickness $t_{tot}$ of the first primary bond 530 in the longitudinal direction $d_l$ is less than the sum $t_{l1}+t_{l2}$ of the thicknesses $t_{l1}$, $t_{l2}$ of the first bond parts 510, 520 in the direction of the normal $N_{511}$ of the first primary surface 511. Preferably, the overlapping distance $d_o$ is from 10% to 90% of the smaller of the thicknesses $t_{l1}$ and $t_{l2}$ of the bond parts 510, 520. More preferably, the overlapping distance $d_o$ is from 25% to 75%, such as from 33% to 66% of the smaller of the thicknesses tit and tit of the bond parts 510, 520.

Figure 6A:
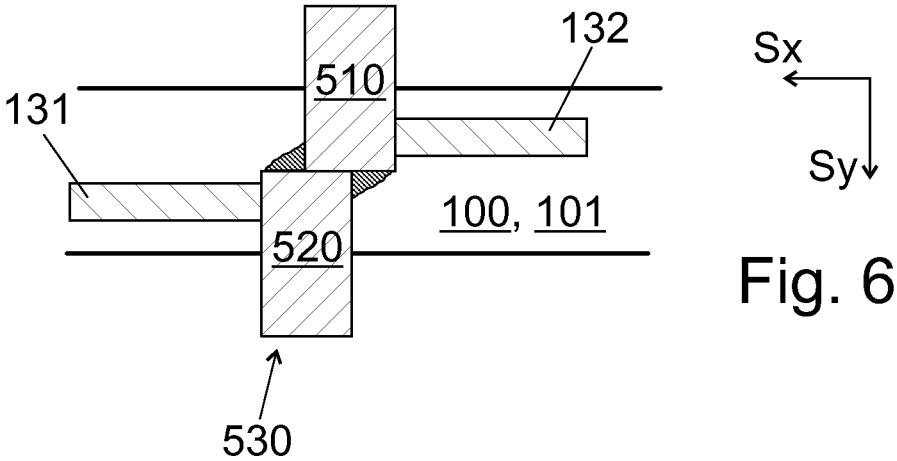
FIG. 6*a* shows, in a top view, a bond and a heat transfer tube with stoppers.
Figure 6B:
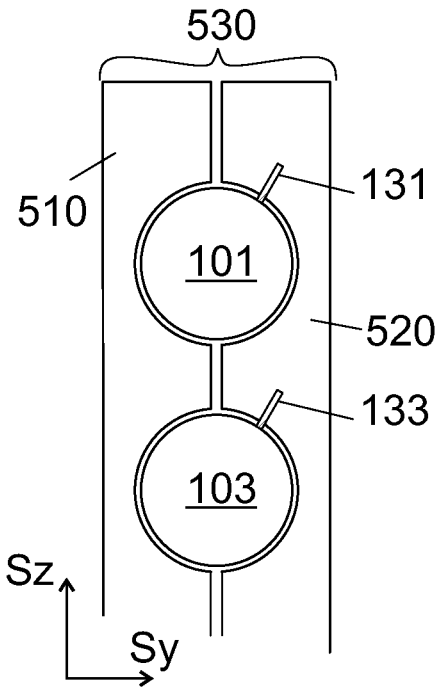
FIG. 6*b* shows, in a first end view, a bond and a heat transfer tube with stoppers.
Figure 6C:
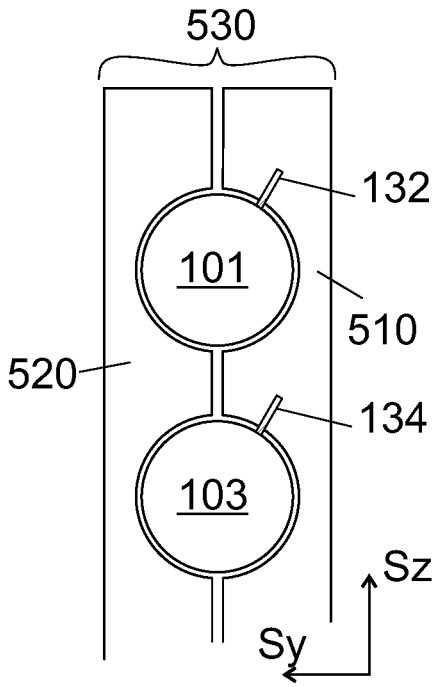
FIG. 6*c* shows, in a second end view, a bond and a heat transfer tube with stoppers.

As indicated above, the movement of the tube parts 101, 103 relative to the bond 530 is diminished primarily by tight fitting of the tube parts 101, 103 to the apertures 533, 534 formed by the holes 514, 515, 524, 525. Moreover, secondarily, the movement can be further diminished by providing stoppers onto some of the surfaces of the tube parts. For this reason, and with reference to FIGS. 6*a* to 6*c*, in an embodiment the first primary straight part 101 of the tube 100 is equipped with a first primary stopper 131 and a first secondary stopper 132. As indicated in FIG. 6*a* for the tube part 101, at least part of the first primary bond 530 is left in between the first primary stopper 131 and the first secondary stopper 132. In this way, the stoppers 131, 132 prevent the movement of the tube part 101 relative to the bond 530; at least when the stoppers 131, 132 are arranged in such a way that the first primary stopper 131 contacts the first primary bond 530 and/or the first secondary stopper 132 contacts the first primary bond 530. In a similar manner the first secondary straight part 103 can be locked to the bond 530. Thus, in an embodiment, the first secondary straight part 103 of the tube 100 is equipped with a second primary stopper 133 and a second secondary stopper 134, as seen from FIGS. 6*b* and 6*c*. At least part of the first primary bond 530 is left in between the second primary stopper 133 and the second secondary stopper 134. However, all the straight parts of the tube(s) need not to be equipped with stopper. Thus, e.g. the first secondary straight part 103 need not be locked to the bond 530 by the stoppers 134, 134. In case the heat exchanger comprises a second heat transfer tube 200, at least one of its straight parts may be equipped with stoppers (not shown).

Referring to FIG. 3*c*, the first primary bond part 510 has a first quaternary surface 514 that forms an angle with the first primary surface 511. This angle may be, but need not be, straight. The first quaternary surface 514 also forms an angle with the first tertiary surface 513. This angle may be, but need not be, straight. The first quaternary surface 514 may be planar. The first quaternary surface 514 also faces away from the first heat transfer tube 100. In a similar manner, the first secondary bond part 520 has a second quaternary surface 524 that forms an angle with the second primary surface 521 and with the second tertiary surface 523 and faces away from the first heat transfer tube 100. In an embodiment, the quaternary surfaces 514 and 524 are not welded together. This has the effect, that when a bridge 551, 552 (see FIG. 11*c*) is used to connect two different bonds together, the bond 530 can be more easily fixed to a bridge 551, 552 from an end of the bond 530, when an end of the bond 530 is free from a welding joint. For example a bridge 551, 552 may be equipped with holes configured to receive the bond 530, in particular the quaternary surfaces 514, 524.

Referring to FIGS. 2*b* and 3*b*, in an embodiment, the first heat transfer tube 100 comprises one or more other straight parts (105, 107), including e.g. the first tertiary straight part 105. In an embodiment, the first primary straight part 101, the first secondary straight part 103, and the other straight parts (105, 107) extend parallel in the first plane P in the longitudinal direction $d_l$. Preferably the tube 100 is designed in such a way that both the distributor header 142 and the collector header 144 are left on the same side of the heat exchanger 10, e.g. on the same side of the tubes (100, 200, 300, 400), as indicated e.g. in FIG. 11*b*. Referring to FIG. 3*b*, in such a case, the first tertiary surface 513 of the first primary bond part 510 is provided with one or more other holes 516, 517 extending through the first primary bond part 510 in the longitudinal direction $d_l$. Moreover, a part or parts of the other straight part or parts 105, 107 is/are arranged into the other hole or holes 516, 517 of the first primary bond part 510. In a similar manner, the second tertiary surface 523 of the first secondary bond part 520 is provided with one or more other holes 526, 527 extending through the first secondary bond part 520 in the longitudinal direction $d_l$. Moreover, a part or parts of the other straight part or parts 105, 107 is/are arranged into the other hole or holes 526, 527 of the first secondary bond part 520. The other holes form other apertures in manner discussed e.g. for the first primary aperture 533, and a straight part of one of the other straight parts (105, 107) extend through one of these other apertures.

Figure 8A:
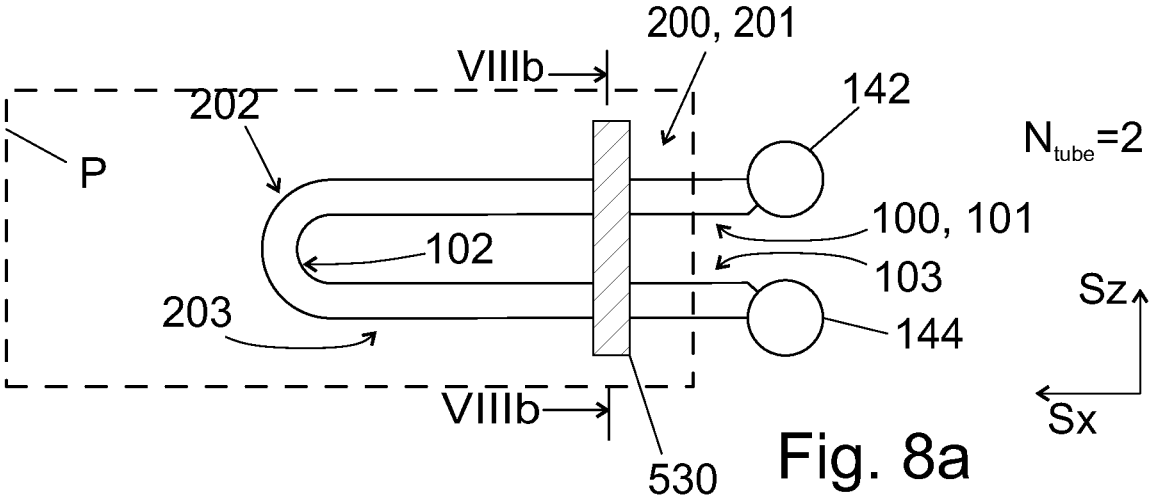
FIG. 8*a* shows, in a side view, an arrangement of two heat transfer tubes and a bond supporting both the heat transfer tubes.
Figure 8B:
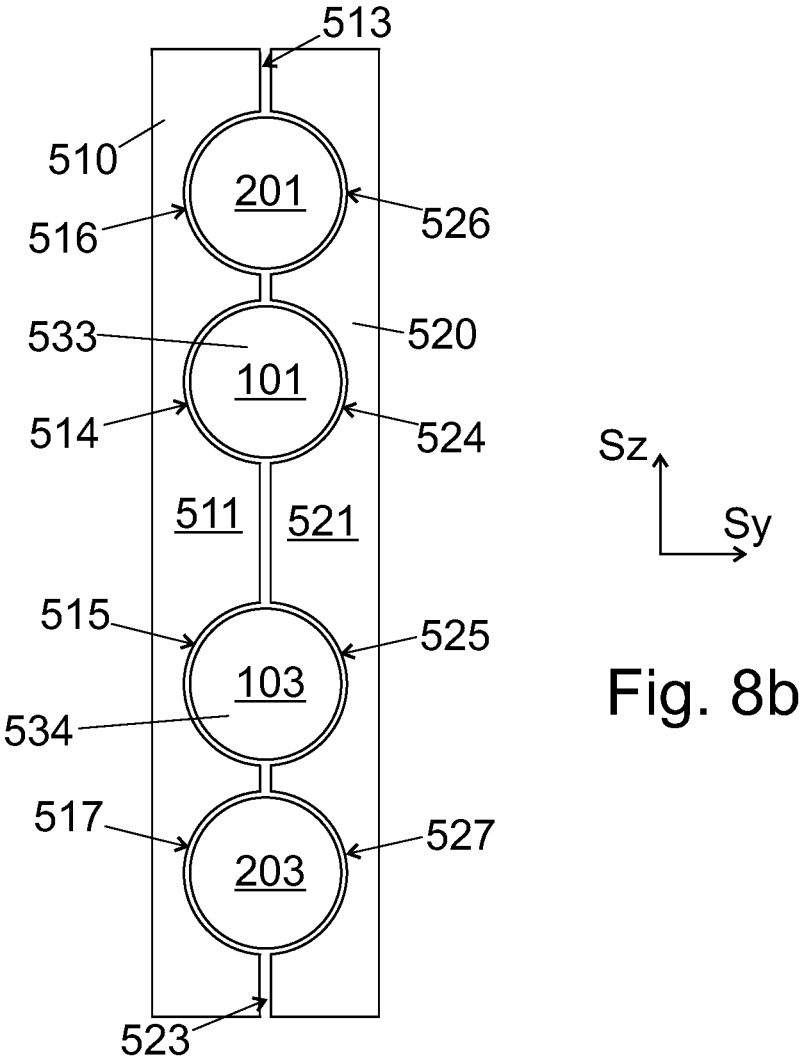
FIG. 8*b* shows the sectional view VIIIb-VIIIb of FIG. 8*a*.

However, it may be feasible to use more than one heat transfer tubes side by side in such a way that the same bond 530 is used to bond more than one heat transfer tubes. With reference to FIG. 8*a*, in an embodiment, the heat exchanger 10 comprises a second heat transfer tube 200. The second heat transfer tube 200 comprises a second primary straight part 201, a second primary curved part 202, and a second secondary straight part 203. Also the second straight parts 201, 203 extend mutually in parallel and in the first plane P, wherein also the first straight parts 101, 103 extend. Moreover, the second straight parts 201, 203 extend in parallel with the first straight parts 101, 103 in the longitudinal direction $d_l$. Referring to FIG. 8*b*, when such tubes 100, 200 are used, the first tertiary surface 513 of the first primary bond part 510 is provided with two or more other holes 516, 517 extending through the first primary bond part 510 in the longitudinal direction $d_l$. Moreover, a part of the second primary straight part 201 is arranged in one (516) of the other holes 516, 517 and a part of the second secondary straight part 203 is arranged in another one (517) of the other holes 516, 517 of the first primary bond part 510. In a similar manner, the second tertiary surface 523 of the first secondary bond part 520 is provided with one or more other holes 526, 527 extending through the first secondary bond part 520 in the longitudinal direction $d_l$. Moreover, a part of the second primary straight part 201 is arranged in one (526) of the other holes 526, 527 and a part of the second secondary straight part 203 is arranged in another one (527) of the other holes 526, 527 of the first secondary bond part 520. The other holes 516, 517, 526, 527 are adapted to the surface of the second heat transfer tube 200 as detailed in connection with the holes 514, 515, 524, 525 and the first heat transfer tube. The other holes form other apertures in manner discussed e.g. for the first primary aperture 533, and straight parts of the other tube 200 extend through these other apertures.

Figure 9A:
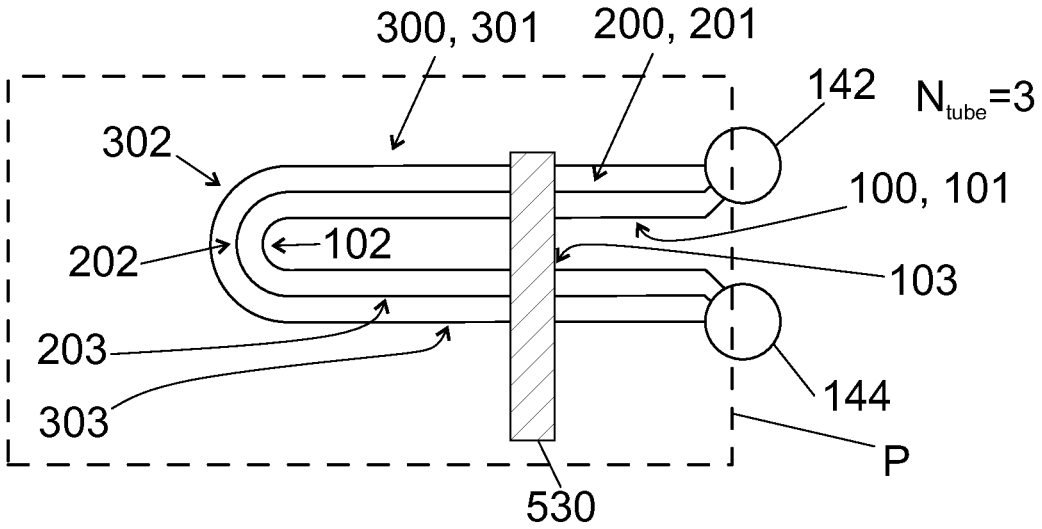
FIG. 9*a* shows, in a side view, an arrangement of three heat transfer tubes and a bond supporting the heat transfer tubes.
Figure 9B:
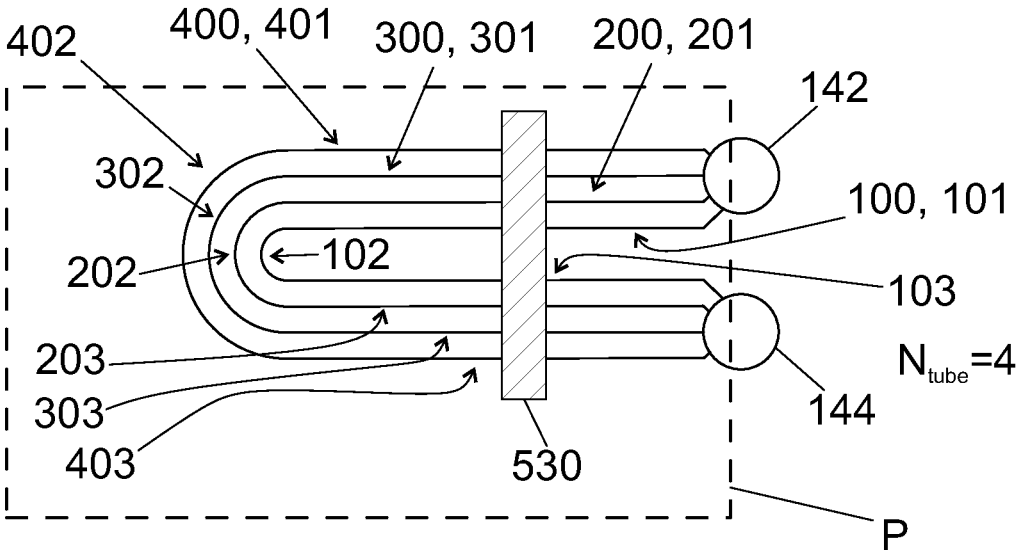
FIG. 9*b* shows, in a side view, an arrangement of four heat transfer tubes and a bond supporting the heat transfer tubes.

Referring to FIGS. 9*a* and 9*b*, it may be feasible to bind even more heat transfer tubes with one bond 530. Thus, in an embodiment, the heat exchanger 10 comprises the first 100 and the second 200 heat transfer tubes as discussed above, and further comprises a third heat transfer tube 300. The third heat transfer tube 300 comprises a third primary straight part 301, a third primary curved part 302, and a third secondary straight part 303. Also the third straight parts 301, 303 extend mutually in parallel and in the first plane P, wherein also the first and second straight parts 101, 103, 201, 203 extend. Moreover, the third straight parts 301, 303 extend in parallel with the first and second straight parts 101, 103, 201, 203 in the longitudinal direction di. A bond 530 can be used to bind the straight parts 101, 201, 301, 103, 203, 303 of the three tubes 100, 200, 300 in the manner discussed above for one or two tubes.

Referring to FIG. 9*b*, in an embodiment, the heat exchanger 10 comprises the first 100, second 200, and third 300 heat transfer tubes as discussed above, and further comprises a fourth heat transfer tube 400. The fourth heat transfer tube 400 comprises a fourth primary straight part 401, a fourth primary curved part 402, and a fourth secondary straight part 403. Also the fourth straight parts 401, 403 extend mutually in parallel and in the first plane P, wherein also the first, second, and third straight parts 101, 103, 201, 203, 301, 303 extend. Moreover, the fourth straight parts 401, 403 extend in parallel with the first, second, and third straight parts 101, 103, 201, 203, 301, 303 in the longitudinal direction $d_l$. A bond 530 can be used to bind the straight parts 101, 201, 301, 401, 103, 203, 303, 403 of the four tubes 100, 200, 300, 400 in the manner discussed above for one or two tubes.

The number $N_{tube}$ of heat transfer tubes, of which straight parts extend in a plane P can be one, as indicated in FIG. 2*a*, two, as indicated in FIG. 8*a*, three, as indicated in FIG. 9*a*, four, as indicated in FIG. 9*b*, five (not shown), six (not shown) or more than six (not shown). Preferably the number $N_{tube}$ of such heat transfer tubes is at least two, two, at least three, three or four. Preferably such a number of tubes and their curved parts are used that the tertiary surface 513, 523 of each one of the bond parts 510, 520 is provided with from 8 to 24 holes, such as from 12 to 18 holes, and a part of a straight part of a heat transfer tube is provided in each one of the holes. Also preferably, the tertiary surface 513, 523 of each one of the bond parts 510, 520 is provided with an even number (i.e. an integer multiple of two) of holes, and a part of a straight part of a heat transfer tube is provided in each one of the holes.

Figure 7A:
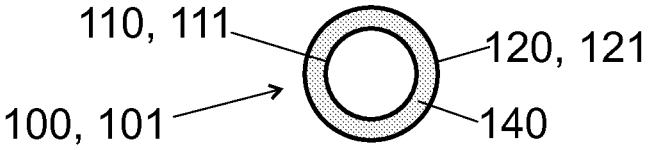
FIG. 7*a* shows a cross section of a straight part of a coaxial heat transfer tube having an inner heat transfer tube and an outer refractory.
Figure 7B:
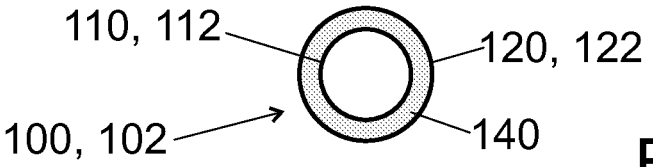
FIG. 7*b* shows a cross section of a curved part of a coaxial heat transfer tube having an inner heat transfer tube and an outer refractory.

Referring now to FIG. 7*a*, the first primary straight part 101 of the first heat transfer tube 100 may comprise a first primary straight part 111 of a first inner heat transfer tube 110 and a first primary straight part 121 of a first outer refractory 120. Optionally, the first primary straight part 101 may comprise some thermally insulating material 140 in between the inner heat transfer tube 110 and the outer refractory 120. Referring to FIG. 7*b*, also the first primary curved part 102 of the first heat transfer tube 100 may comprise a first primary curved part 112 of the first inner heat transfer tube 110 and a first primary curved part 122 of the first outer refractory 120. Optionally, the first primary curved part 101 may comprise some thermally insulating material 140 in between the inner heat transfer tube 110 and the outer refractory 120. This has the beneficial effect as disclosed in the prior art publication U.S. Pat. No. 9,371,987. In a similar manner, any or all of the second heat transfer tube 200, the third heat transfer tube 300, and the fourth heat transfer tube 400 may comprise an inner tube and outer refractory.

Having an outer refractory 120 has the further beneficial effect that, in use, the temperature of an outer surface of the refractory 120 is much higher than a temperature of a heat transfer tube 100, if it consisted of a plain heat transfer tube. Moreover, the temperature of the first primary bond 530 is also high in use. Thus, having an outer refractory diminishes temperature difference, in use, between the bond 530 and the outer surface of the tube 100. This improves the fitting in between the bond 530 and the tube 100 also in use. Moreover, this also diminishes warping of the bond 530 in use.

Figure 10:
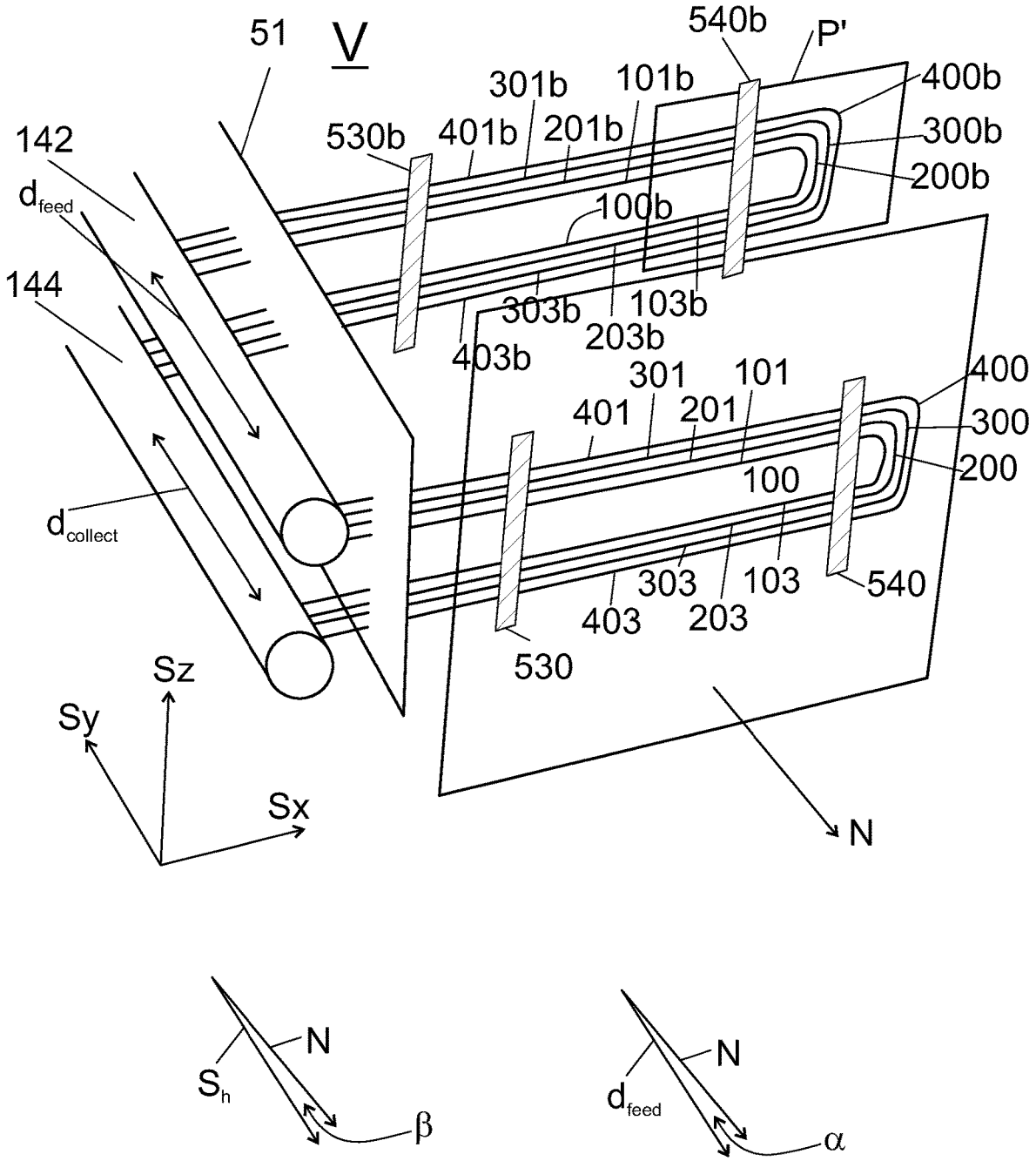
FIG. 10 shows, in a perspective view, a first arrangement of four heat transfer tubes and two bonds supporting these heat transfer tubes, and a second arrangement of four heat transfer tubes and two bonds supporting these heat transfer tubes.
Figure 11B:
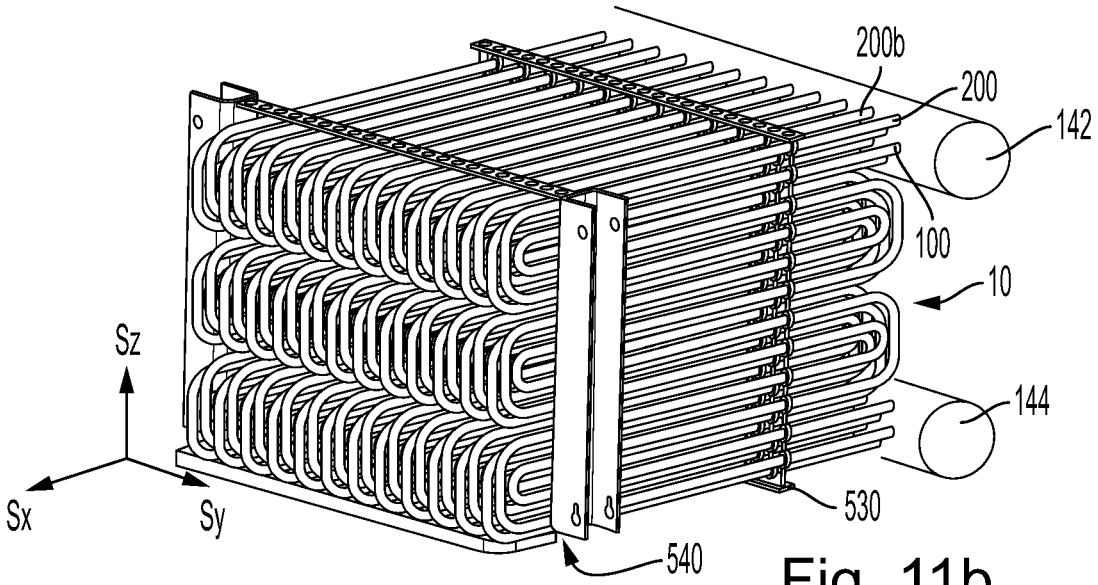
FIG. 11*b* shows, in a perspective view, an arrangement assembly of multiple heat transfer tube arrangements of FIG. 11*a*.
Figure 11C:
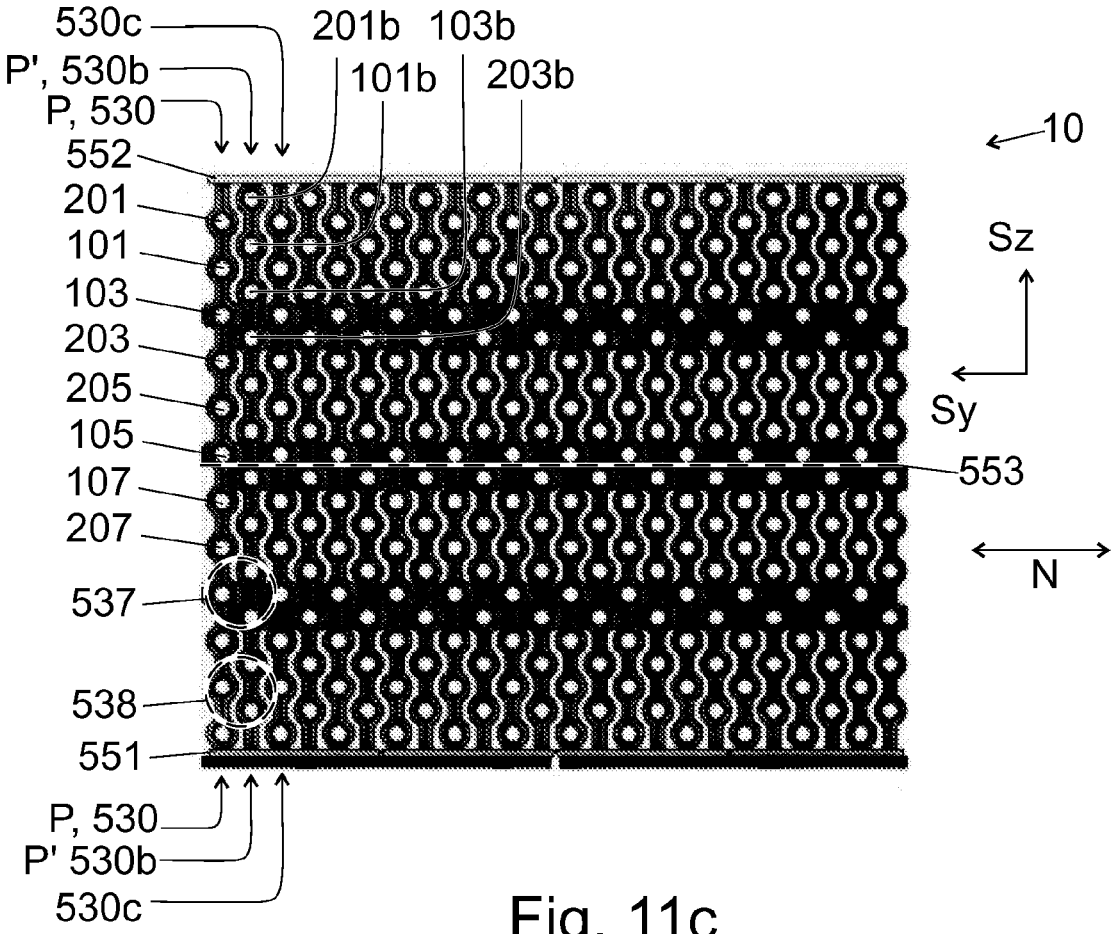
FIG. 11*c* shows, in an end view, the arrangement assembly of FIG. 11*b*.

A heat exchanger 10 typically comprises a first heat transfer tube arrangement comprising the first 100 (and optionally also second, third, fourth, fifth and sixth 200, 300, 400) heat transfer tubes that extend in the same plane P; and the first primary bond 530, and optionally the first secondary bond 540 binding these tubes together. Referring to FIGS. 10, 11*b* and 11*c*, a heat exchanger 10 typically comprises a second heat transfer tube arrangement comprising at least a secondary first heat transfer tube 100*b* extending in a second plane P', which is parallel to the first plane P. The second heat transfer tube arrangement may further comprise a secondary second heat transfer tube 200*b* extending in the second plane P', optionally also a secondary third heat transfer tube 300*b* extending in the second plane P', and optionally also a secondary fourth heat transfer tube 400*b* (and optionally also secondary fifth and secondary sixth heat transfer tubes) extending in the second plane P'. Referring to FIGS. 10 and 11*c*, the tubes of the second heat transfer tube arrangement may be joined using a second primary bond 530*b*; and optionally also a second secondary bond 540*b*. As indicated in FIG. 10, the secondary first heat transfer tube 100*b* comprises straight parts 101*b*, 103*b* similar to the first heat transfer tube 100. In a similar manner the secondary second heat transfer tube 200*b* comprises straight parts 201*b*, 203*b*, the secondary third heat transfer tube 300*b* comprises straight parts 301*b*, 303*b*, and the secondary fourth heat transfer tube 400*b* comprises straight parts 401*b*, 403*b*. In a similar manner, a third heat transfer tube arrangement may be joined using a third primary bond 530*c* (see FIG. 11*c*).

The second heat transfer tube arrangement (100*b*, 200*b*, 300*b*, 400*b*) is supported by the second primary bond 530*b* in a same manner as the first heat transfer tube arrangement (100, 200, 300, 400) is supported by the first primary bond 530. Thus, in an embodiment, the heat exchanger 10 comprises a second primary bond 530*b* that is configured to support at least two other straight parts (101*b*, 103*b*, 201*b*, 203*b*, 301*b*, 303*b*, 401*b*, 403*b*) of at least one other heat transfer tube (100*b*, 200*b*, 300*b*, 400*b*), i.e. a secondary heat transfer tube. Moreover, the other at least two straight parts of the secondary heat transfer tube or tubes (100*b*, 200*b*, 300*b*, 400*b*) extend parallel with each other in a second plane P'. The second plane P' is parallel to the first plane P. Moreover, the second plane P' is arranged at a distance from the first plane P.

Referring to FIG. 11*c*, in an embodiment the first primary bond 530 is connected to the second primary bond 530*b* by a first bridge 551. In the embodiment of FIG. 11*c*, an end of the first primary bond 530 is fixed to the first bridge 551 and an end of the second primary bond 530*b* is fixed to the first bridge 551. Moreover, all the heat transfer tubes 100, 200, 100*b*, 200*b* of the heat exchanger 10 are arranged on a same side of the first bridge 551. For example in FIG. 11*c*, all the heat transfer tubes are arranged above the first bridge 551. In addition, the embodiment of FIG. 11*c* comprises a second bridge 552. Another end of the first primary bond 530 is fixed to the second bridge 552 and another end of the second primary bond 530*b* is fixed to the second bridge 552. Moreover, all the heat transfer tubes 100, 200, 100*b*, 200*b* of the heat exchanger 10 are arranged in between the first bridge 551 and the second bridge 552. The purpose of the bridges 551, 552 is to bind the primary bonds 530, 530*b* together. The bridges 551, 552 provide for mechanical support for the tubes 100, 200, 100*b*, 200*b* in a direction of a normal N of the first plane P; which, in use, may be horizontal. The bonds 530, 530*b* provide for mechanical support for the tubes 100, 200, 100*b*, 200*b* in another direction, which, in use, may be vertical.

Referring to FIG. 11*c*, in an embodiment, at least at one point in between [i] two straight parts of a tube that are separated by a curved part of the tube or [ii] two straight parts different tubes, in a direction of the first plane P, the second primary bond 530*b* contacts the first primary bond 530 to form a mechanical locking 537 between the first primary bond 530 and the second primary bond 530*b*. This helps to lock the tubes to each other also in a direction of a normal N of the first plane P and also in a central part of the heat exchanger. This is particularly feasible in case of a modular heat exchanger. In the mechanical locking 537 a surface of the first primary bond 530 that faces away from the first heat transfer tube 100 in a direction of a normal N of the first plane P contacts a surface of the second primary bond 530*b* that faces away from the secondary first heat transfer tube 100*b* in a direction of a normal of the second plane P'. The mechanical locking 537 can, in some tube configurations, be made with a central bridging element 553. The central bridging element 553 can be fixed to both the first primary bond 530 and the second primary bond 530*b*. The mechanical locking (537, 553) is made at a point that is left in a direction within the first plane P and perpendicular to the longitudinal direction $d_l$ (i.e. the direction $d_{ext}$ of FIG. 3*c*) in between [i] two straight parts of a tube that are separated by a curved part of the tube or [ii] two straight parts different tubes.

Moreover, preferably in some regions, a gap 538 (i.e. a distance) is left in between the second primary bond 530*b* and the first primary bond 530, as indicated by the reference numeral 538 in FIG. 11*c*. As indicated in FIG. 11*c*, such a gap 538 is left in between the second primary bond 530*b* and the first primary bond 530 in a direction of a normal N of the first plane P.

The heat exchanger 100 needs not comprise the first bridge 551, since a central bridging element 553 (i.e. a first central bridging element 533) can be used for the purpose of binding the bonds 530, 530*b* together near an end of the bonds. The heat exchanger 100 needs not comprise the second bridge 552, since a central bridging element 553 (i.e. a second central bridging element) can be used for the purpose of binding the bonds 530, 530*b* together near another end of the bonds. However, preferably to elements (bridges and/or central bridging elements) are used to connect the bonds 530, 530*b* together.

Referring to FIG. 10, from the point of view of modularity, it is beneficial that the heat exchanger 10 has substantially rectangular shape. More precisely, in an embodiment, the heat exchanger 10 comprises the distributor header 142 and the collector header 144 such that the distributor header 142 extends in a first direction $d_{feed}$. From the point of view of modularity, it is beneficial that the normal N of the first plane P is parallel to the first direction $d_{feed}$ or forms an angle $\alpha$ of at most 60 degrees with the first direction $d_{feed}$. It is also preferable, that the first plane P is, in use substantially vertical. Thus, in an embodiment, a normal N of the first plane P is configured to be horizontal in use to form an angle $\beta$ of at most 45 degrees with a horizontal direction $S_h$ in use. At least in such a case, the heat exchanger forms a modular assembly that can be inserted into the space V and removed therefrom via an opening in the wall 51. Such procedure is described in more detail in an international patent application PCT/FI2016/050760.

Preferably the heat exchanger 10 is used in a fluidized bed boiler as a fluidized bed heat exchanger 10. More preferably the fluidized bed heat exchanger 10 is used in a loopseal 5 of a circulating fluidized bed boiler. Thus, in an embodiment, the fluidized bed boiler 1 comprises means 40 for separating bed material from flue gas. Referring to FIG. 1*a*, in an embodiment, the fluidized bed boiler 1 comprises a cyclone 40 for separating bed material from flue gas. The fluidized bed boiler comprises a loopseal 5 configured to receive bed material from the means 40 for separating bed material from flue gas (e.g. from the cyclone). Moreover, at least a part of the fluidized bed heat exchanger 10 is arranged in the loopseal 5. Referring to FIGS. 2*b*, 2*c*, 7*a*, 7*b*, and 8, for example, the distributor header 142 and to collector header 144 may be arranged outside the loopseal. However, at least most of the heat transfer tubes (100, 200) or heat transfer tubes (110, 120, 210, 220) are arranged in to the loopseal as indicated above. For example, in an embodiment, at least 90% of the heat transfer tubes (100, 200) or heat transfer tubes (110, 120, 210, 220) of the fluidized bed heat exchanger 10, as measured lengthwise, are arranged in the loopseal 5 as indicated above.

The invention claimed is:

1. A heat exchanger comprising a first heat transfer tube having a first primary straight part, a first primary curved part, and a first secondary straight part, the straight parts extending parallel in a first plane in a longitudinal direction, a first primary bond part comprising:

(i) a first primary surface, (ii) a first secondary surface opposite the first primary surface, (iii) a first tertiary surface, of which at least a part faces in a direction of a normal of the first plane, the first tertiary surface extending from the first primary surface to the first secondary surface, and which connects the first primary surface and the first secondary surface, and (iv) on the first tertiary surface, a first primary hole and a first secondary hole, both extending through the first primary bond part in the longitudinal direction, a first secondary bond part comprising:

(i) a second primary surface, (ii) a second secondary surface opposite the second primary surface, (iii) a second tertiary surface, of which at least a part faces in a direction of a normal of the first plane, the second tertiary surface extending from the second primary surface to the second secondary surface, and which connects the second primary surface and the second secondary surface, and (iv) on the second tertiary surface, a second primary hole and a second secondary hole, both extending through the first secondary bond part in the longitudinal direction, a first welding joint that joins the second tertiary surface to the first primary surface or the first secondary surface, and a second welding joint that joins the first tertiary surface to the second secondary surface or the second primary surface, respectively, wherein:

the first primary bond part has been welded to the first secondary bond part to form a first primary bond that bonds parts of the first heat transfer tube, the first primary bond limiting:

(i) a first primary aperture formed by the first primary hole and the second primary hole, wherein the first primary straight part extends through the first primary bond in the longitudinal direction via the first aperture, and (ii) a first secondary aperture formed by the first secondary hole and the second secondary hole, wherein the first secondary straight part extends through the first primary bond via the first secondary aperture, a shape of the first primary aperture has been adapted to a shape of an outer surface of the first primary straight part, and a shape of the first secondary aperture has been adapted to a shape of an outer surface of the first secondary straight part.

2. The heat exchanger of the claim 1, wherein:

in between the first primary hole and the first secondary hole the first primary bond part has a minimum first secondary thickness in a direction that is perpendicular to a normal of the first primary surface and forms a minimum angle with a normal of the first plane, the minimum first secondary thickness is from 10 mm to 50 mm, in between the second primary hole and the second secondary hole, the first secondary bond part has a minimum second secondary thickness in a direction that is perpendicular to a normal of the second primary surface and forms a minimum angle with a normal of the first plane, and at least one of:

the minimum second secondary thickness is from 10 mm to 50 mm; or the minimum first secondary thickness equals the minimum second secondary thickness.

3. The heat exchanger of claim 1, wherein a part of the first tertiary surface faces a part of the second tertiary surface, such that a total thickness of the first primary bond in a direction of a normal of the first primary surface is less than the sum of the thicknesses of the first bond parts in the direction of the normal of the first primary surface.

4. The heat exchanger of claim 3, wherein:

the first welding joint extends in a direction that is within the first plane and perpendicular to the longitudinal direction, the second welding joint extends in a direction that is within the first plane and perpendicular to the longitudinal direction.

5. The heat exchanger of claim 1, wherein:

the first primary bond part has a first primary thickness in a direction of a normal of the first primary surface, the first primary thickness being from 15 mm to 40 mm, and the first secondary bond part has a second primary thickness in a direction of a normal of the second primary surface, the second primary thickness being from 15 mm to 40 mm.

6. The heat exchanger of claim 1, comprising:

on the first primary straight part, a first primary stopper and a first secondary stopper such that at least part of the first primary bond is left in between the first primary stopper and the first secondary stopper.

7. The heat exchanger of claim 1, wherein:

the first heat transfer tube comprises one or more other straight parts, the primary and secondary straight parts and the other straight parts extending parallel in the first plane in the longitudinal direction, the first primary bond part comprises on the first tertiary surface one or more other holes extending through the first primary bond part in the longitudinal direction such that a part or parts of the other straight part or parts is/are arranged into the other hole or holes of the first primary bond part, and the first secondary bond part comprises on the second tertiary surface one or more other holes extending through the first secondary bond part in the longitudinal direction such that a part or parts of the other straight part or parts is/are arranged into the other hole or holes of the first secondary bond part.

8. The heat exchanger of claim 1, comprising:

a second heat transfer tube having a second primary straight part, a second primary curved part, and a second secondary straight part, the straight parts extending parallel in the first plane in the longitudinal direction, wherein:

the first primary bond part comprises on the first tertiary surface at least two other holes extending through the first primary bond part in the longitudinal direction such that a part of the second primary straight part and a part of the second secondary straight part are arranged in the other holes of the first primary bond part, and the first secondary bond part comprises on the second tertiary surface at least two other holes extending through the first secondary bond part in the longitudinal direction such that a part of the second primary straight part and a part of the second secondary straight part are arranged in the other holes of the first secondary bond part.

9. The heat exchanger of claim 1, comprising:

a first secondary bond configured to bind together at least the first primary straight part and the first secondary straight part.

10. The heat exchanger of claim 1, comprising:

a second primary bond configured to support at least two other straight parts of another heat transfer tube or other heat transfer tubes, wherein:

the two other straight parts of the other heat transfer tube/tubes extend parallel with each other in a second plane, and the second plane is parallel to the first plane and arranged at a distance from the first plane.

11. The heat exchanger of the claim 10, wherein:

the second primary bond is connected to the first primary bond by at least two of the following:

a first bridge, a second bridge, a first central bridging element; or a second central bridging element.

12. A fluidized bed boiler, comprising:

a furnace, a flue gas heat exchanger configured to recover heat from flue gas expelled from the furnace, walls limiting a space into which a fluidized bed is configured to form in use of the fluidized bed boiler, and a heat exchanger according to claim 1, wherein at least a part of the heat exchanger is arranged in the space.

13. The fluidized bed boiler of claim 12, comprising:

means for separating bed material from flue gas, and a loopseal configured to receive bed material from the means for separating bed material from flue gas, wherein at least a part of the heat exchanger is arranged in the loopseal.

14. A method for manufacturing a heat exchanger, the method comprising steps of:

arranging available:

(i) a first heat transfer tube having a first primary straight part, a first primary curved part, and a first secondary straight part, the straight parts extending parallel in a first plane in a longitudinal direction, and (ii) a plate made of material that is suitable for a bond of heat transfer tubes of the heat exchanger, the plate having a thickness in a direction and a main surface, of which surface normal is parallel to the direction of thickness, cutting from the plate a first primary bond part comprising:

(i) a first primary surface and an opposite first secondary surface such that a part of the main surface forms the first primary surface or the first secondary surface, (ii) a first tertiary surface, (iii) on the first tertiary surface, a first primary hole extending through the first primary bond part from the first primary surface to the first secondary surface and configured to receive a part of the first primary straight part of the first heat transfer tube, and (iv) on the first tertiary surface, a first secondary hole extending through the first primary bond part from the first primary surface to the first secondary surface and configured to receive a part of the first secondary straight part of the first heat transfer tube, cutting from the plate or a second plate a first secondary bond part comprising:

(i) a second primary surface and an opposite second secondary surface such that a part of the main surface or a part of a main surface of the second plate forms the second primary surface or the second secondary surface, (ii) a second tertiary surface, (iii) on the second tertiary surface, a second primary hole extending through the first secondary bond part from the second primary surface to the second secondary surface and configured to receive a part of the first primary straight part of the first heat transfer tube, and (iv) on the second tertiary surface, a second secondary hole extending through the first secondary bond part from the second primary surface to the second secondary surface and configured to receive a part of the first secondary straight part of the first heat transfer tube, arranging a part of the first primary straight part of the first heat transfer tube to the first primary hole such that an outer surface of the first primary straight part is adapted to the surface of the first primary hole, arranging a part of the first primary straight part of the first heat transfer tube to the second primary hole such that an outer surface of the first primary straight part is adapted to the surface of the second primary hole, arranging a part of the first secondary straight part of the first heat transfer tube to the first secondary hole, arranging a part of the first secondary straight part of the first heat transfer tube to the second secondary hole, welding the first primary bond part to the first secondary bond part to form a first primary bond that bonds the straight parts of the first heat transfer tube, forming the first tertiary surface by said cutting from the plate the first primary bond part, forming the second tertiary surface by said cutting from the plate or a second plate the first secondary bond part, welding the second tertiary surface to the first primary surface or the first secondary surface, and welding the first tertiary surface to the second secondary surface or the second primary surface.

15. The method of claim 14, wherein the plate comprises metal.

16. The method of claim 14, wherein the thickness of the plate is from 15 mm to 40 mm.

17. The method of claim 14, wherein the plate is cut by using a laser or a fluid jet.

18. The method of claim 14, comprising welding the bond parts such that a part of the first tertiary surface faces a part of the second tertiary surface.

19. The heat exchanger of claim 4, wherein the first and second welding joints extend in said direction at least 5 cm.

* * * * *